US009111501B2

(12) United States Patent
Kobayashi et al.

(10) Patent No.: US 9,111,501 B2
(45) Date of Patent: Aug. 18, 2015

(54) DISPLAY DEVICE

(75) Inventors: Masamitsu Kobayashi, Osaka (JP); Tomoyuki Ishihara, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 538 days.

(21) Appl. No.: 13/636,422

(22) PCT Filed: Feb. 22, 2011

(86) PCT No.: PCT/JP2011/053791

§ 371 (c)(1),
(2), (4) Date: Sep. 21, 2012

(87) PCT Pub. No.: WO2011/132455

PCT Pub. Date: Oct. 27, 2011

(65) Prior Publication Data

US 2013/0010017 A1 Jan. 10, 2013

(30) Foreign Application Priority Data

Apr. 19, 2010 (JP) ..... 2010-095965

(51) Int. Cl.
*G09G 5/10* (2006.01)
*G09G 3/36* (2006.01)

(52) U.S. Cl.
CPC ..... *G09G 3/3648* (2013.01); *G09G 2310/0235* (2013.01); *G09G 2320/0242* (2013.01)

(58) Field of Classification Search
CPC ..... G09G 3/3648; G09G 2320/0242; G09G 2310/0235; G09G 2320/064; G09G 2360/16; G09G 3/3413
See application file for complete search history.

(56) References Cited

U.S. PATENT DOCUMENTS 8,279,138 B1 * 10/2012 Margulis ..... 345/1.1
2006/0192792 A1 8/2006 Inazumi
2007/0132680 A1 * 6/2007 Kagawa et al. ..... 345/84

(Continued)

FOREIGN PATENT DOCUMENTS

JP 2000-171898 6/2000
JP 2006-235443 9/2006
JP 2007-17862 1/2007

(Continued)

OTHER PUBLICATIONS

International Search Report mailed Mar. 29, 2011, directed towards International Application No. PCT/JP2011/053791; 4 pages.

*Primary Examiner* — Abbas Abdulselam
(74) *Attorney, Agent, or Firm* — Morrison & Foerster LLP

(57) ABSTRACT

The present invention aims to provide a display device capable of displaying an image in a color maintaining a hue and a tone expected from an input signal.
In a field-sequential liquid crystal display device, when a red image is displayed, red light is transmitted in the first subframe period, and further, green light and blue light are transmitted in the second and third subframe periods, respectively. Therefore, the blue component of an input signal is adjusted such that the transmittance of the liquid crystal panel is at a predetermined value even in the third subframe period. As a result, the hue of an image displayed on the liquid crystal panel is the same as or almost the same as the hue of red expected from the input signal. Moreover, the color of red displayed on the liquid crystal panel maintains the tone value of the color expected from the input signal.

14 Claims, 18 Drawing Sheets

(56) References Cited

U.S. PATENT DOCUMENTS

| | | | | |
|---|---|---|---|---|
| 2010/0053136 | A1 | 3/2010 | Ohta et al. | |
| 2011/0063330 | A1 * | 3/2011 | Bae et al. | 345/690 |

FOREIGN PATENT DOCUMENTS

| | | |
|---|---|---|
| JP | 2008-58613 | 3/2008 |
| WO | WO-2008/068920 | 6/2008 |

* cited by examiner

FIG. 7

LUT15a

| INPUT SIGNAL | CORRECTION SIGNAL |
|---|---|
| (255, 0, 0) | (pr, pr, pb) |
| ⋮ | ⋮ |
| (255, 255, 255) | (255, 255, 255) |
| (0, 255, 0) | (qr, qg, qb) |
| ⋮ | ⋮ |
| (255, 255, 255) | (255, 255, 255) |
| (0, 0, 255) | (rr, rg, rb) |
| ⋮ | ⋮ |
| (255, 255, 255) | (255, 255, 255) |
| (0, 255, 255) | (sr, sg, sb) |
| ⋮ | ⋮ |
| (255, 0, 255) | (tr, tg, tb) |
| ⋮ | ⋮ |
| (255, 255, 255) | (255, 255, 255) |
| (255, 255, 0) | (ur, ug, ub) |
| ⋮ | ⋮ |
| (255, 255, 255) | (255, 255, 255) |

FIG. 13

LUT15a

| INPUT SIGNAL | CORRECTION SIGNAL |
|---|---|
| (255, 0, 0) | (pr, pr, pb) |
| ⋮ | ⋮ |
| (255, 255, 255) | (255, 255, 255) |
| (0, 255, 0) | (qr, qg, qb) |
| ⋮ | ⋮ |
| (255, 255, 255) | (255, 255, 255) |
| (0, 0, 255) | (rr, rg, rb) |
| ⋮ | ⋮ |
| (255, 255, 255) | (255, 255, 255) |
| (0, 255, 255) | (sr, sg, sb) |
| ⋮ | ⋮ |
| (255, 0, 255) | (tr, tg, tb) |
| ⋮ | ⋮ |
| (255, 255, 255) | (255, 255, 255) |
| (255, 255, 0) | (ur, ug, ub) |
| ⋮ | ⋮ |
| (255, 255, 255) | (255, 255, 255) |
| (255, 0, 0) | (pr, pr, pb) |
| ⋮ | ⋮ |
| (255, 255, 0) | (ur, ug, ub) |
| ⋮ | ⋮ |
| (0, 255, 0) | (qr, qg, qb) |
| ⋮ | ⋮ |
| (0, 255, 255) | (sr, sg, sb) |
| ⋮ | ⋮ |
| (0, 0, 255) | (rr, rg, rb) |
| ⋮ | ⋮ |
| (255, 0, 255) | (tr, tg, tb) |
| ⋮ | ⋮ |
| (255, 0, 0) | (pr, pg, pb) |

DISPLAY DEVICE

REFERENCE TO RELATED APPLICATIONS

This application is a national stage application under 35 USC 371 of International Application No. PCT/JP2011/053791, filed Feb. 22, 2011, which claims the priority of Japanese Patent Application No. 2010-095965, filed Apr. 19, 2010, the entire contents of which are incorporated herein by reference.

FIELD OF THE INVENTION

The present invention relates to display devices, more specifically to a display device, such as a liquid crystal display device, which provides color display using a field-sequential system.

BACKGROUND OF THE INVENTION

Most of the liquid crystal display devices that provide color display include sets of color filters for transmitting red (R), green (G), and blue (B) light therethrough, such that one set is provided for every three subpixels into which one pixel is divided. However, about ⅔ of backlight irradiated on a liquid crystal panel is absorbed by the color filters, and therefore liquid crystal display devices using color filters have a problem of low light-use efficiency. Accordingly, attention is focused on field-sequential liquid crystal display devices which provide color display without using color filters.

In the field-sequential system, a display period for one screen (one frame period) is divided into three subframe periods. In the first subframe period, a red component of an input signal is inputted to display a red screen, in the second subframe period, a green component is inputted to display a green screen, and in the third subframe period, a blue component is inputted to display a blue screen, so that a color image is displayed on the liquid crystal panel. In this manner, field-sequential liquid crystal display devices can dispense with color filters and therefore have about three times the light-use efficiency of liquid crystal display devices using color filters.

Japanese Laid-Open Patent Publication No. 2006-235443 describes a liquid crystal display device in which color signals included in input signals are distributed to subframes of base colors and complementary colors, such that differences in tone between the subframes are rendered small while maintaining colors expected from input signals of the base colors alone. To take advantage of the response speed of the liquid crystal being proportional to differences in tone, this liquid crystal display device renders differences in tone small between subframes to minimize color shifts between images. Specifically, when there are three base colors, red, green, and blue, colors in an image are distributed to subframes for red, green, blue, and complementary colors thereof, i.e., six colors in total, in accordance with predetermined equations. At this time, a color distribution ratio is obtained such that the sum of the absolute values of differences in tone between adjacent subframes is minimized while maintaining colors expected from input signals of the base colors alone. Color signals are distributed to the subframes on the basis of the color distribution ratio thus obtained, thereby rendering the differences in tone small between the subframes. As a result, the response speed of the liquid crystal becomes faster than in the case where the differences in tone are large, so that the color shifts between images can be minimized.

Patent Document 1: Japanese Laid-Open Patent Publication No. 2006-235443

SUMMARY OF THE INVENTION

A description will be given regarding problems with image display on a conventional liquid crystal display device using the field-sequential system. Note that in the following, each of the red, green, and blue components of an input signal externally provided to the liquid crystal display device is 8-bit data. Accordingly, the liquid crystal display device displays each of red, green, and blue at up to 256 tone levels. Moreover, the liquid crystal used is of a normally black type.

A description will be given regarding the case where the liquid crystal display device displays an image with the transmittance of the liquid crystal panel significantly changing between adjacent subframes. FIG. 19 is a diagram illustrating the luminance of a liquid crystal panel for each subframe period where a conventional field-sequential liquid crystal display device displays a red still image, in which the horizontal axis represents time and the vertical axis represents the transmittance of the liquid crystal panel.

In the case where an image is displayed with tone values for red, green and blue at 255, 0, and 0, respectively, a red backlight emits light in the first subframe period, and a red component with the red tone value at 255 is inputted, as shown in FIG. 19. At this time, the transmittance of the liquid crystal panel increases from 0% over time, and reaches 100% after a predetermined time period. Consequently, red light from the red backlight is transmitted through the liquid crystal panel, so that the red image is displayed with a tone value of 255.

In the second subframe period, a green backlight emits light, and a green component with a green tone value of 0 is inputted. At this time, the transmittance of the liquid crystal panel is normally at 0%, and the liquid crystal panel blocks green backlight, so that no green image is displayed. However, even when the green component with a green tone value of 0 is inputted, the transmittance of the liquid crystal panel does not instantly fall from 100%, the percentage in the first subframe period, to 0%. In this manner, the transmittance of the liquid crystal panel in the second subframe period is affected by the transmittance in the first subframe period, so that time is taken before the transmittance of the liquid crystal panel falls to 0%, the percentage to be taken naturally. During this time, the green light from the green backlight that is to be blocked by the liquid crystal panel is partially transmitted, so that a green image is displayed.

In the second subframe period, the transmittance of the liquid crystal panel ultimately reaches 0%, so that the transmittance of the liquid crystal panel is 0% from the beginning of the third subframe period. Accordingly, in the third frame period, if a blue component with a blue tone value of 0 is inputted, the transmittance of the liquid crystal panel remains 0%. Therefore, the blue light from the blue backlight is blocked by the liquid crystal panel and cannot be transmitted therethrough, so that no blue image is displayed. As a result, the viewer sees an image of red mixed with green. Such red mixed with green differs in hue from the original color of red that should be displayed.

Furthermore, the method described in Japanese Laid-Open Patent Publication No. 2006-235443 is based on the premise that a delay in response of the liquid crystal is proportional to differences in tone between adjacent subframes. However, the delay in response of the liquid crystal is not determined only by the differences in tone. Accordingly, the delay in response of the liquid crystal often varies even for the same degree of difference in tone. In such a case, even by using the method described in Japanese Laid-Open Patent Publication No. 2006-235443, it is not possible to accurately correct a color shift between images due to a delay in response of the liquid crystal.

Therefore, an objective of the present invention is to provide a display device capable of displaying an image in a color maintaining a hue and a tone expected from an input signal.

A first aspect of the present invention is directed to a display device for displaying a screen in a different color for each of a plurality of subframe periods into which a frame period is divided, the device comprising:

a display panel including a plurality of pixel formation portions arranged in a matrix;

a color correction circuit for outputting correction signals for controlling light transmittances of the pixel formation portions, in each of the subframe periods on the basis of input signals; and a driver circuit for driving the pixel formation portions on the basis of the correction signals, wherein, the color correction circuit includes a look-up table having correction signals stored therein in correlation with the input signals specifying colors included in predetermined hues, the correction signals specifying colors maintaining hues and tones of the colors specified by the input signals, and when the input signals are provided, the color correction circuit reads the correction signals correlated to the input signals from the look-up table, and output the correction signals to the driver circuit.

In a second aspect of the present invention, based on the first aspect of the invention, the correction signals stored in the look-up table in correlation with the input signals specify first pixel display points in a chromaticity diagram, the first pixel display points being on first straight lines extending between a white point with all color components of the input signals at maximum levels and first primary-color chromaticity points with at least one of the color components at a maximum level and the remaining at a minimum level, and the first pixel display points being obtained on the basis of the first primary-color chromaticity points.

In a third aspect of the present invention, based on the second aspect of the invention, when one of the first pixel display points is not on the first straight line, the correction signal stored in the look-up table in correlation with the input signal specifies anew first pixel display point being the closest displayable points to the first display point that is not on the first straight line within a predetermined distance therefrom.

In a fourth aspect of the present invention, based on the second aspect of the invention, the correction signals stored in the look-up table in correlation with the input signals respectively specify a plurality of second pixel display points sequentially obtained between the white point and the first pixel display points on the first straight lines.

In a fifth aspect of the present invention, based on the fourth aspect of the invention, the correction signals stored in the look-up table in correlation with the input signals respectively specify a plurality of second pixel display points obtained at intervals of equal length into which the first straight lines are divided.

In a sixth aspect of the present invention, based on the fourth aspect of the invention, when one of the second pixel display points is not on the first straight line, the correction signal stored in the look-up table in correlation with the input signal specifies a new second pixel display point being the closest displayable point to the second display point that is not on the first straight line.

In a seventh aspect of the present invention, based on the second aspect of the invention, the correction signals stored in the look-up table in correlation with the input signals respectively specify a plurality of second pixel display points obtained at intervals of equal length into which first curves extending between the white point and the first pixel display points are divided.

In an eighth aspect of the present invention, based on the second aspect of the invention, the correction signals stored in the look-up table in correlation with the input signals respectively specify a plurality of fourth pixel display points sequentially obtained on lines connecting the first pixel display points and third pixel display points obtained on the basis of the second primary-color chromaticity points adjacent to the first primary-color chromaticity points, the fourth pixel display points being positioned between the first pixel display points and the third pixel display points.

In a ninth aspect of the present invention, based on the eighth aspect of the invention, the fourth pixel display points respectively specified by the correction signals stored in the look-up table in correlation with the input signals are obtained at intervals of equal length into which second straight lines connecting the first pixel display points and the third pixel display points are divided.

In a tenth aspect of the present invention, based on the ninth aspect of the invention, when one of the fourth pixel display points is not on the second straight line, the correction signal stored in the look-up table in correlation with the input signal specifies a new fourth pixel display point being the closest displayable point to the fourth pixel display point that is not on the second straight line.

In an eleventh aspect of the present invention, based on the eighth aspect of the invention, the fourth pixel display points respectively specified by the correction signals stored in the look-up table in correlation with the input signals are obtained at intervals of equal length into which second curves connecting the first pixel display points and the third pixel display points are divided.

In a twelfth aspect of the present invention, based on the first aspect of the invention, a thermometer provided on the display panel is further comprised, the correction signals stored in the look-up table are correlated to the input signals for each piece of temperature information provided by the thermometer, and when the input signals are provided, the color correction circuit reads the correction signals from the look-up table on the basis of the temperature information.

In a thirteenth aspect of the present invention, based on the first aspect of the invention, the predetermined hues include red, green, and blue.

In a fourteenth aspect of the present invention, based on the first aspect of the invention, images, including still images, are displayed on the display panel on the basis of the input signals.

According to the first aspect, the correction signals stored in the look-up table in correlation with the input signals specifying colors included in predetermined hues specify colors maintaining the hues and the tones of colors expected to be displayed in accordance with the input signals. Accordingly, when an input signal is provided to the display device, the color correction circuit reads a correction signal correlated to the input signal from the look-up table, and outputs the correction signal to the driver circuit. Thus, the display device can display an image in a color maintaining the hue and the tone of a color expected to be displayed in accordance with an input signal.

According to the second aspect, the first pixel display points specified by the correction signals stored in the look-up table in correlation with the input signals are positioned on the first straight lines extending between the white point and the first primary-color chromaticity points and obtained on the basis of the first primary-color chromaticity points. Thus, the display device can display images in colors maintaining the hues of the colors specified by the first primary-color chromaticity points.

According to the third aspect, when one of the first pixel display points is not on the first straight line, the correction signal stored in the look-up table in correlation with the input signal specifies a new first pixel display point which is a displayable point specifying substantially the same color as the first pixel display point that is not on the first straight line. Thus, the display device can display images in colors of substantially the same hues as the colors specified by the first primary-color chromaticity points.

According to the fourth aspect, the correction signals stored in the look-up table in correlation with the input signals specify the second pixel display points sequentially obtained between the white point and the first pixel display points. Thus, the display device can display images in colors maintaining the hues and the tones of colors specified by chromaticity points between the white point and the first primary-color chromaticity points.

According to the fifth aspect, the correction signals stored in the look-up table in correlation with the input signals specify the second pixel display points sequentially obtained at intervals of equal length into which the first straight lines are divided. Thus, the positions of the second pixel display points can be readily obtained, so that the look-up table can be created with ease.

According to the sixth aspect, when one of the second pixel display points is not on the first straight line, the correction signal stored in the look-up table in correlation with the input signal specifies a new second pixel display point which is a displayable point specifying substantially the same color as the second pixel display point that is not on the first straight line. Thus, the display device can display an image in a color maintaining substantially the same hue and tone as a color specified by a color chromaticity point between the white point and the first pixel display point.

According to the seventh aspect, the correction signals stored in the look-up table in correlation with the input signals specify the second pixel display points sequentially obtained at intervals of equal length into which first curves extending between the white point and the first pixel display points are divided. Thus, the range of color reproduction by the display device can be widened. Moreover, in the case where the range of color reproduction by the display device is represented by a concave shape, the look-up table can be created without including any correction signals specifying displayable points not available for the display device.

According to the eighth aspect, the correction signals stored in the look-up table in correlation with the input signals specify the fourth pixel display points sequentially obtained on lines connecting the first pixel display points obtained on the basis of the first primary-color chromaticity points and the third pixel display points obtained on the basis of the second primary-color chromaticity points adjacent to the first primary-color chromaticity points. Thus, the display device can display images in colors maintaining the hues and the tones of colors specified by chromaticity points between the first and second primary-color chromaticity points.

According to the ninth aspect, the fourth pixel display points specified by the correction signals stored in the look-up table in correlation with the input signals are sequentially obtained at intervals of equal length into which the second straight lines connecting the first pixel display points and the third pixel display points are divided. Thus, the positions of the fourth pixel display points can be readily obtained, so that the look-up table can be created with ease.

According to the tenth aspect, when one of the fourth pixel display points is not on the second straight line, the correction signal stored in the look-up table in correlation with the input signal specifies a new fourth pixel display point which is a displayable point specifying substantially the same color as the fourth pixel display point that is not on the second straight line. Thus, the display device can display images in colors maintaining substantially the same hues and tones of colors as specified by chromaticity points between the first and second primary-color chromaticity points.

According to the eleventh aspect, the fourth pixel display points specified by the correction signals stored in the look-up table in correlation with the input signals are sequentially obtained at intervals of equal length into which second curves connecting the first pixel display points and the third pixel display points are divided. Thus, the range of color reproduction by the display device can be widened. Moreover, in the case where the range of color reproduction by the display device is represented by a concave shape, the look-up table can be created without including any correction signals specifying displayable points not available for the display device.

According to the twelfth aspect, the display device has the thermometer provided on the display panel, and the correction signals stored in the look-up table are correlated to the input signals for each piece of temperature information. Thus, the color correction circuit can read the correction signals from the look-up table in accordance with the temperature information provided by the thermometer. In this case, the display device displays an image in accordance with a correction signal corresponding to the temperature of the display panel, and therefore the influence of the temperature can be minimized even if the display speed of the display device varies in accordance with the temperature.

According to the thirteenth aspect, when an input signal specifying a color with the hue of red, green, or blue is provided, the display device can display an image in a color maintaining the hue and the tone of the color expected to be displayed from the input signal.

According to the fourteenth aspect, the display device is suitable for displaying images including still images.

BRIEF DESCRIPTION OF THE DRAWINGS

FIG. 7 is a diagram illustrating the configuration of an LUT provided in the liquid crystal display device shown in FIG. 1.

FIG. 13 is a diagram illustrating the configuration of an LUT provided in the liquid crystal display device according to the second embodiment.

DETAILED DESCRIPTION OF THE INVENTION

1. First Embodiment

1.1 Configuration of the Liquid Crystal Display Device

Figure 1:
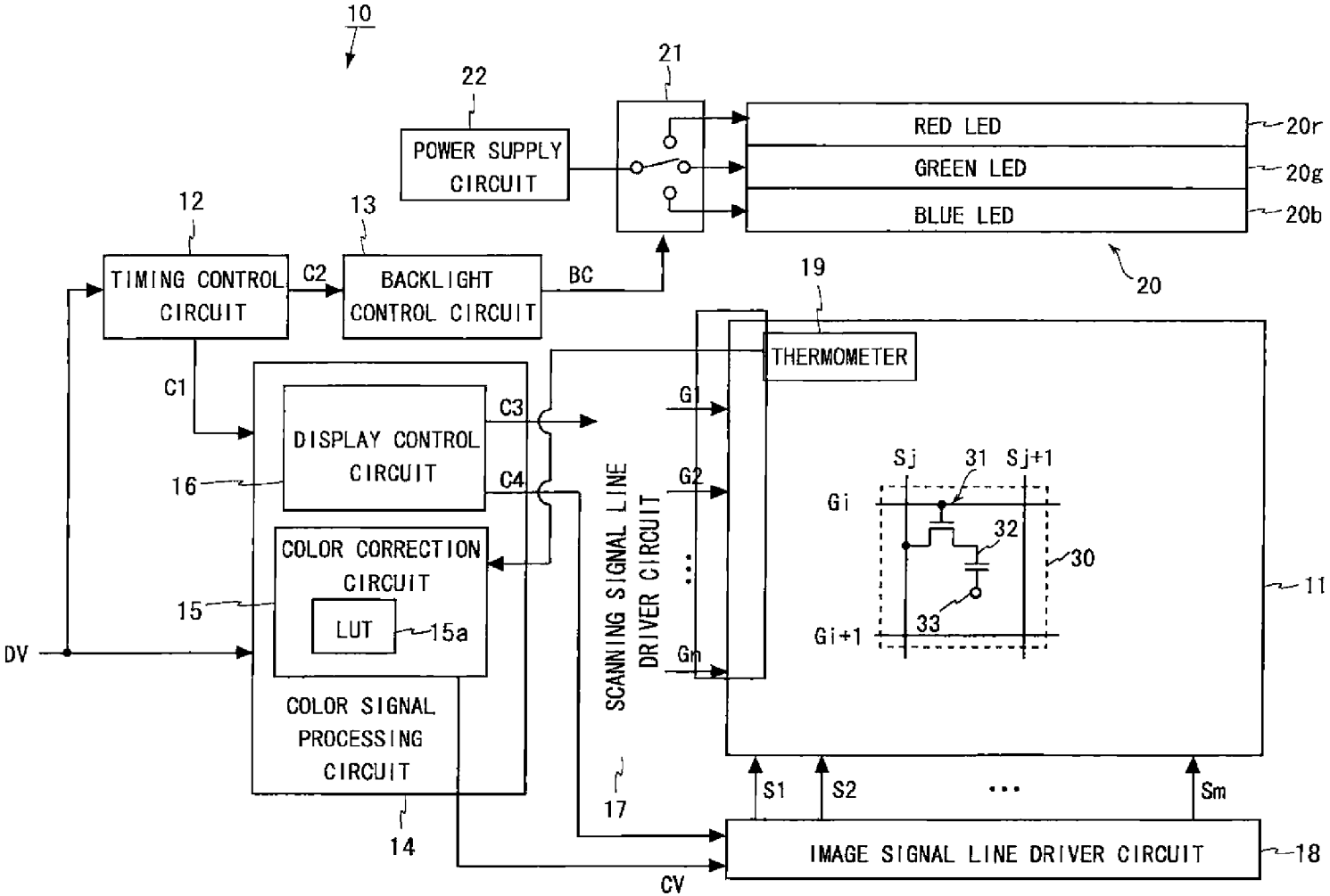
FIG. 1 is a block diagram illustrating the configuration of a field-sequential liquid crystal display device according to a first embodiment.

FIG. 1 is a block diagram illustrating the configuration of a field-sequential liquid crystal display device 10 according to a first embodiment of the present invention. The liquid crystal display device 10 shown in FIG. 1 provides color display using a field-sequential color system in which one frame period is divided into three subframe periods. The liquid crystal display device 10 includes a liquid crystal panel 11, a scanning signal line driver circuit 17, an image signal line driver circuit 18, a thermometer 19, a color signal processing circuit 14, a timing control circuit 12, a backlight control circuit 13, a backlight unit 20, a switch 21, and a power supply circuit 22.

In the following, for example, one frame period is 1/60 of a second, and each subframe period is 1/180 of a second. Moreover, each of the red, green, and blue components of an input signal externally provided to the liquid crystal display device 10 is 8-bit data. In this case, the liquid crystal display device 10 can represent each of the colors, red, green, and blue, at 256 tone levels, so that the liquid crystal panel 11 can display about 16.78 million colors (to be exact, 256×256×256 colors).

The liquid crystal panel 11 includes a plurality (m) of image signal lines $S_1$ to $S_m$, a plurality (n) of scanning signal lines $G_1$ to $G_n$, and a plurality (m×n) of pixel formation portions 30 provided at their respective corresponding intersections of the image signal lines $S_1$ to $S_m$ and the scanning signal lines $G_1$ to $G_n$. Each pixel formation portion 30 includes a TFT 31 functioning as a switching element, a pixel electrode 32 connected to a drain terminal of the TFT 31, and a common electrode 33 forming liquid crystal capacitance together with the pixel electrode 32. The TFT 31 has a gate terminal connected to the scanning signal line $G_i$ ($1 \le i \le n$) and a source terminal connected to the image signal line $S_j$ ($1 \le j \le m$).

An input signal DV is externally provided to the timing control circuit 12 and the color signal processing circuit 14. The timing control circuit 12 generates control signals $C_1$ and $C_2$ on the basis of the input signal DV, such that the timing of lighting up red, green, and blue LEDs (light-emitting diodes) 20*r*, 20*g*, and 20*b* included in the backlight unit 20 is synchronized with the timing of the image signal line driver circuit 18 outputting red, green, and blue drive image signals to the image signal lines $S_1$ to $S_m$. The timing control circuit 12 provides the control signal $C_1$ to the color signal processing circuit 14 and the control signal $C_2$ to the backlight control circuit 13.

The color signal processing circuit 14 includes a color correction circuit 15 and a display control circuit 16, and the color correction circuit 15 includes a look-up table (LUT) 15*a*. The LUT 15*a* has stored therein a plurality of input signals DV, and a plurality of correction signals CV respectively correlated to the input signals DV. When an input signal DV is provided to the color correction circuit 15 in the color signal processing circuit 14, the color correction circuit 15 reads in real-time a correction signal CV correlated to that input signal DV from the LUT 15*a*, and provides that correction signal CV to the image signal line driver circuit 18. Note that each of the input signal DV and the correction signal CV is represented by a set of red, green, and blue components R, G, and B. The red, green, and blue components R, G, and B represent tone values for red, green, and blue, respectively.

On the basis of the control signal $C_1$ provided by the timing control circuit 12 and the externally provided input signal DV, the display control circuit 16 generates a control signal (e.g., a gate clock signal or suchlike) $C_3$ for the scanning signal line driver circuit 17 and a control signal (e.g., a source clock signal or suchlike) $C_4$ for the image signal line driver circuit 18. The display control circuit 16 provides the control signal $C_4$ to the image signal line driver circuit 18 and the control signal $C_3$ to the scanning signal line driver circuit 17.

The scanning signal line driver circuit 17 sequentially outputs active scanning signals to the scanning signal lines $G_1$ to $G_n$ on the basis of the control signal $C_3$. The image signal line driver circuit 18 generates drive image signals on the basis of the correction signal CV, and outputs the drive image signals to the image signal lines $S_1$ to $S_m$ at times determined by the control signal $C_4$. The drive image signals outputted to the image signal lines $S_1$ to $S_m$ are charged in pixel capacitance via the TFTs 31 connected to the active scanning signal lines $G_1$ to $G_n$. As a result, voltages corresponding to the drive image signals are applied to the liquid crystal, and the transmittance of the liquid crystal changes in accordance with the applied voltages, so that an image is displayed on the liquid crystal panel 11. Note that the scanning signal line driver circuit 17 and the image signal line driver circuit 18 are also collectively called a driver circuit.

The backlight unit 20 includes two-dimensionally arranged red, green, and blue LEDs (light-emitting diodes) 20*r*, 20*g*, and 20*b*. The red, green, and blue LEDs 20*r*, 20*g*, and 20*b* are connected to the power supply circuit 22 via the switch 21. On the basis of the control signal $C_2$ provided by the timing control circuit 12, the backlight control circuit 13 generates a backlight control signal BC for shifting the switch 21 for each subframe period in a sequential manner, and provides the backlight control signal BC to the switch 21. Since the switch 21 is shifted in a sequential manner on the basis of the backlight control signal BC, the red, green, and blue LEDs 20*r*, 20*g*, and 20*b* are sequentially supplied with a source voltage by the power supply circuit 22. As a result, the red, green, and blue LEDs 20*r*, 20*g*, and 20*b* sequentially emit light in accordance with the timing of the drive image signals being applied to the image signal lines $S_1$ to $S_m$, so that the liquid crystal panel 11 is illuminated from the back by red, green, and blue light sequentially but one in each subframe period. Note that in place of the red, green, and blue LEDs 20*r*, 20*g*, and 20*b*, red, green, and blue CCFLs (cold cathode fluorescent lamps) may be used as light sources included in the backlight unit 20.

Figure 2:
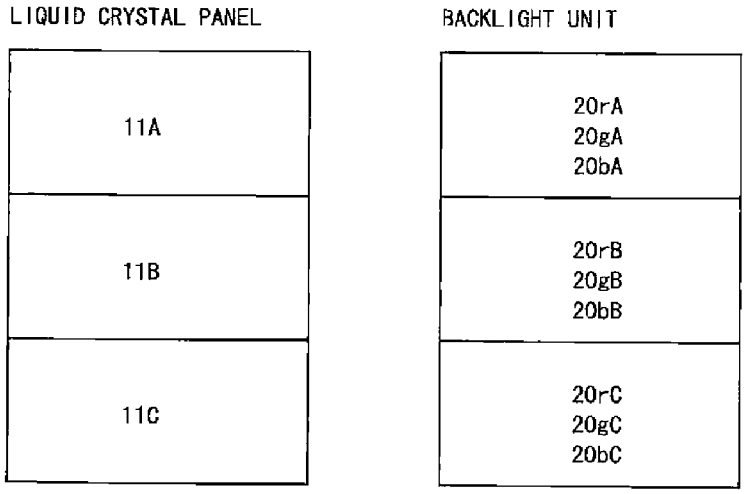
FIG. 2 is a diagram in which each of a liquid crystal panel and LEDs of various colors in the liquid crystal display device shown in FIG. 1 is divided into three areas.
Figure 3:
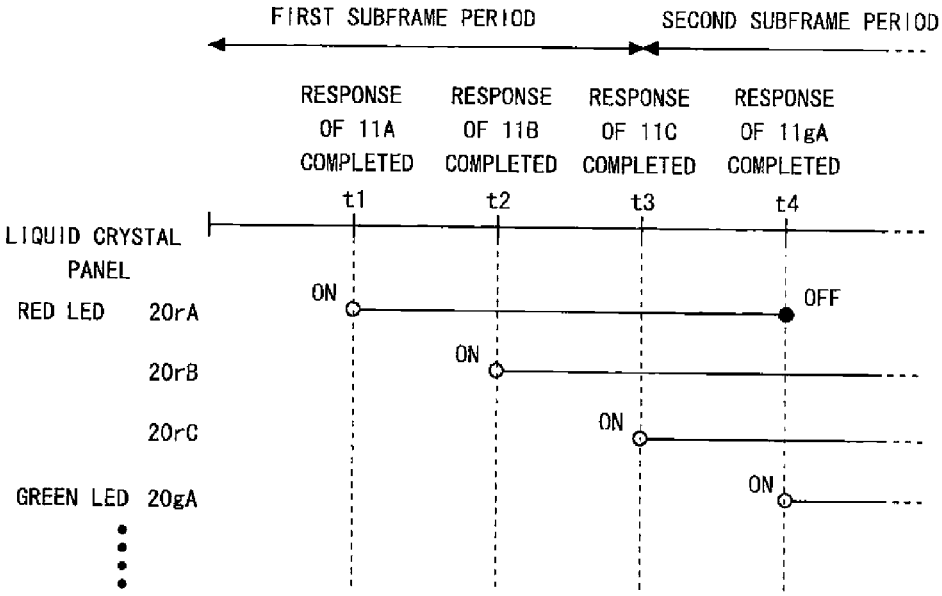
FIG. 3 is a diagram illustrating the timing of controlling the lighting up of the LEDs in subframe periods in the liquid crystal display device shown in FIG. 1.

In general, the response of the liquid crystal to the drive image signal being provided to the pixel formation portion 30 is late compared to the response of the backlight, and therefore it is necessary to control the timing of lighting up the backlight considering such late response of the liquid crystal. Accordingly, an exemplary backlight control method considering the late response of the liquid crystal will be described specifically. FIG. 2 is a diagram in which each of the liquid crystal panel 11 and the LEDs 20*r* to 20*b* of various colors is divided into three areas, and FIG. 3 is a diagram illustrating the timing of controlling the lighting up of the LEDs 20*r* to 20*b* in subframe periods. As shown in FIG. 2, the liquid crystal panel 11 is divided into three areas $\mathbf{11}_A$ to $\mathbf{11}_C$, and each of the LEDs 20*r* to 20*b* of various colors is also divided into three groups corresponding to areas $\mathbf{11}_A$ to $\mathbf{11}_C$. As shown in FIG. 3, all red LEDs $\mathbf{20}r_A$ corresponding to area $\mathbf{11}_A$ are simultaneously lit up at time $t_1$ when the liquid crystal in all pixel formation portions 30 included in area $\mathbf{11}_A$ of the liquid crystal panel 11 responds to the drive image signals and is placed in proper orientation. Next, all red LEDs $\mathbf{20}r_B$ corresponding to area $\mathbf{11}_B$ are simultaneously lit up at time $t_2$ when the liquid crystal in all pixel formation portions 30 included in area $\mathbf{11}_B$ responds to the drive image signals and is placed in proper orientation. Thereafter, all red LEDs $\mathbf{20}r_C$ corresponding to area $\mathbf{11}_C$ are simultaneously lit up at time $t_3$. At time $t_4$, all red LEDs $\mathbf{20}r_A$ corresponding to area $\mathbf{11}_A$ are simultaneously turned off, and all green LEDs $\mathbf{20}g_A$ corresponding to area $\mathbf{11}_A$ are simultaneously lit up. Thereafter, similar operations of lighting up and turning off are repeated in a sequence from the green LED $\mathbf{20}g_B$ to the blue LED $\mathbf{20}b_C$. As a result, the backlight can be lit up in accordance with the response of the liquid crystal.

The changing speed of the liquid crystal orientation direction varies significantly depending on the ambient temperature, and the change in speed is fast at high temperature and becomes slower as the temperature falls. Accordingly, even if the voltage applied to pixel capacitance is not changed, the transmittance of the liquid crystal panel 11 changes fast when the temperature around the liquid crystal is high, and it changes slowly at lower temperatures. Therefore, to measure the temperature of the liquid crystal panel 11, the thermometer 19 is provided at the liquid crystal panel 11. The temperature of the liquid crystal panel 11 measured by the thermometer 19 is provided to the color correction circuit 15 as temperature information.

The LUT 15*a* includes the correspondence between the input signals DV and the correction signals CV, created for each piece of temperature information provided by the thermometer 19. When an input signal DV is externally provided, the color correction circuit 15 reads a correction signal CV stored in correlation with the provided input signal DV from the LUT 15*a*. The correction signal CV being read is provided to the image signal line driver circuit 18 and converted into a drive image signal before it is provided to the liquid crystal panel 11. As a result, the liquid crystal panel 11 displays an image in a color corresponding to the correction signal CV. The color of the image displayed maintains a hue and a tone of a color expected from the input signal DV, as will be described later. The liquid crystal display device 10 displays the image in accordance with the correction signal CV corresponding to the temperature of the liquid crystal panel 11. Accordingly, even when the response speed of the liquid crystal changes in accordance with the temperature, the liquid crystal display device 10 can display an image while minimizing the effect of the temperature. Note that in the case where the liquid crystal display device 10 is intended to be used in an environment where the temperature barely changes, the LUT 15*a* includes the correspondence between input signals DV and correction signals CV only for specific temperatures.

In the first subframe period, the pixel formation portions 30 are driven on the basis of the red component of the correction signal CV obtained through conversion by the color correction circuit 15, and the red LEDs 20*r* emit light. Similarly, in the second subframe period, the pixel formation portions 30 are driven on the basis of the green component of the correction signal CV, and the green LEDs 20*g* emit light. In the third subframe period, the pixel formation portions 30 are driven on the basis of the blue component of the correction signal CV, and the blue LEDs 20*b* emit light. As a result, the screen of the liquid crystal panel 11 appears red to a degree corresponding to the red component in the first subframe period, green to a degree corresponding to the green component in the second subframe period, and blue to a degree corresponding to the blue component in the third subframe period. In this case, since the subframe periods are short, the liquid crystal display device 10 can display a color image taking advantage of an afterimage on the human retina.

1.2 Principle of Color Correction

Figure 4:
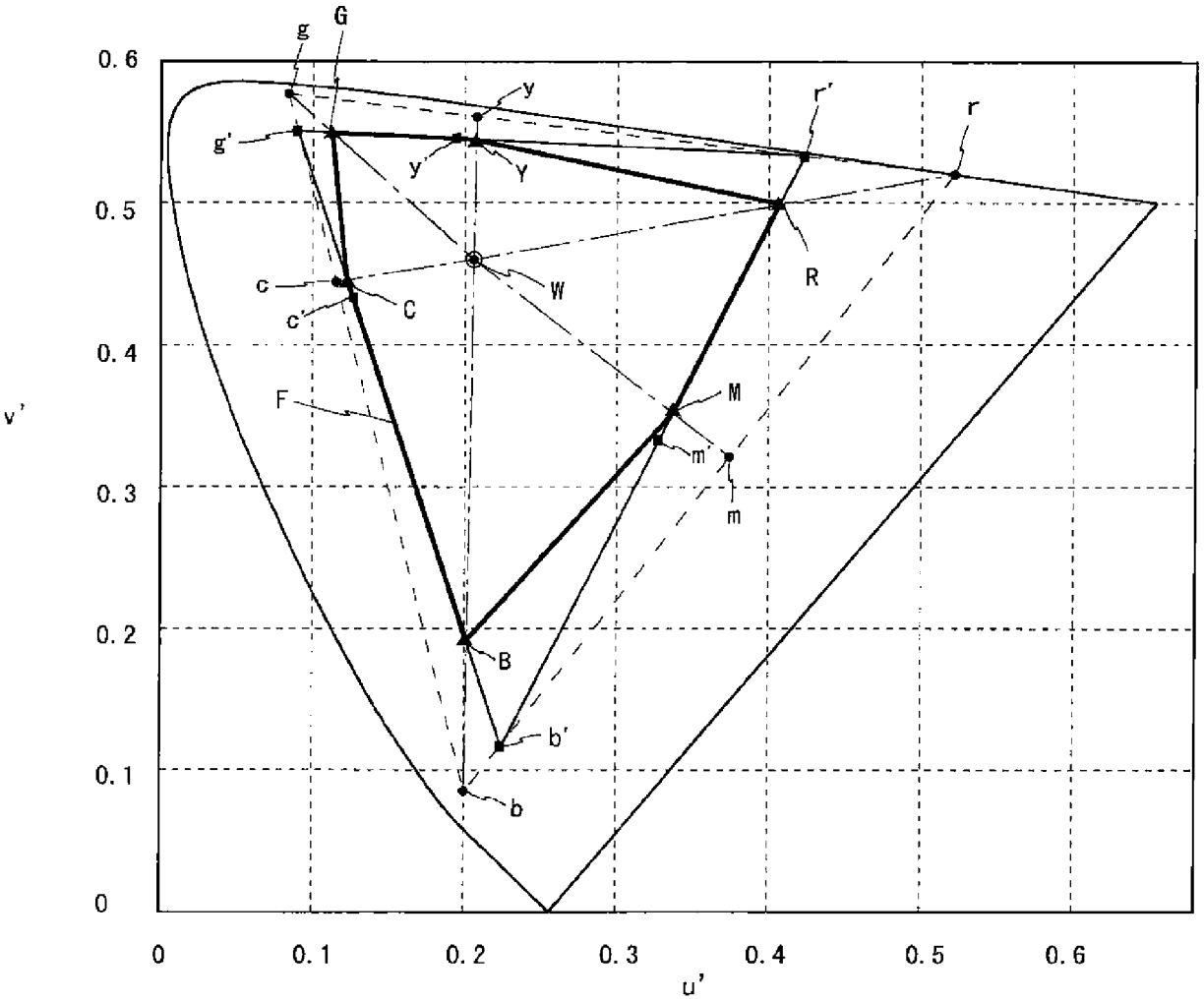
FIG. 4 is a chromaticity diagram showing the range of color reproduction by the liquid crystal display device shown in FIG. 1 in a u'v' coordinate system.

Color characteristics of an image displayed on a liquid crystal display device are represented by a chromaticity diagram as defined by the International Commission on Illumination (Commission Internationale de l'Eclairage). FIG. 4 is a chromaticity diagram showing the range of color reproduction by the liquid crystal display device 10 shown in FIG. 1 in a u'v' coordinate system. In FIG. 4, a horseshoe-shaped area indicates the range of visible light. In the horseshoe-shaped area, an upper right portion represents red, an upper left portion represents green, and a center bottom portion represents blue. Points included within the horseshoe-shaped area (hereinafter, referred to as "chromaticity points") specify visible light of their respective different colors. In triangle rgb having vertices at primary-color chromaticity points r, g, and b, primary-color chromaticity points r, g, and b are chromaticity points respectively indicating colors of light emitted by the red, green, and blue LEDs 20*r*, 20*g*, and 20*b*. Accordingly, triangle rgb represents the range of color reproduction where the LEDs 20*r* to 20*b* of these three colors emit light.

Conventional field-sequential liquid crystal display devices can display colors specified by chromaticity points enclosed within triangle r'g'b' in the horseshoe-shaped area. Triangle r'g'b' includes about 16.78 million chromaticity points respectively corresponding to about 16.78 million colors that can be displayed. In the following, about 16.78 million chromaticity points that can be displayed by conventional field-sequential liquid crystal display devices will be referred to as displayable points.

The size of triangle r'g'b' varies in accordance with the response speed of liquid crystal used. Specifically, the size of triangle r'g'b' increases as the response speed of liquid crystal rises, and it decreases as the response speed of liquid crystal falls. In the case where a normally black-type liquid crystal is used, when all of the red, green, and blue components are at 255, the transmittance of the liquid crystal panel 11 is 100%, so that the liquid crystal panel 11 displays white. In addition, when all of the color components are at 0, the transmittance of the liquid crystal panel 11 is 0%, so that the liquid crystal panel 11 displays black. In FIG. 4, point W indicates the position of a white point, which is a point to be displayed when an input signal DV with each color component at 255 is provided. Accordingly, in the following, chromaticity point W will be called white point W.

In conventional field-sequential liquid crystal display devices, when the liquid crystal panel 11 is irradiated with red (the color at primary-color chromaticity point r) light emitted by the red LEDs 20*r* to display a red image, the liquid crystal panel 11 displays a color resulting from red being mixed with green (the color at primary-color chromaticity point g) emitted by the green LEDs 20*g*, due to a delayed response of the liquid crystal. The color resulting from red being mixed with green is the color specified by chromaticity point r' in FIG. 4. Herein, when an input signal DV expected to represent the color at primary-color chromaticity point r is provided, the chromaticity point of a color displayed on the liquid crystal panel 11 due to a delayed response of the liquid crystal, such as chromaticity point r', will be referred to as the uncorrected chromaticity point and denoted by the symbol (') being assigned to the reference character for a corresponding primary-color chromaticity point.

Likewise, when the liquid crystal panel 11 is irradiated with green light emitted by the green LEDs 20*g* to display a green image corresponding to primary-color chromaticity point g, the liquid crystal panel 11 displays a color (the color at uncorrected chromaticity point g') resulting from green being mixed with blue (the color at primary-color chromaticity point b) emitted by the blue LEDs 20*b*, and when the liquid crystal panel 11 is irradiated with blue light emitted by the blue LEDs 20*b* to display a blue image, the liquid crystal panel 11 displays a color (the color at uncorrected chromaticity point b') resulting from blue being mixed with red emitted by the red LEDs 20*r*. This is similarly true for yellow, cyan, and magenta. In this manner, conventional field-sequential liquid crystal display devices cannot display a color maintaining the hue of a color expected from an input signal DV.

Next, the principle of the color correction to be made in the present embodiment will be described. Initially, signals respectively corresponding to about 16.78 million displayable points enclosed within triangle r'g'b' shown in FIG. 4 are sequentially inputted to a conventional field-sequential liquid crystal display device, and chromatic coordinates of colors displayed on the liquid crystal panel are measured with a colorimeter. In this manner, the correspondence between chromatic coordinates of about 16.78 million displayable points and signals are obtained. In this case, the chromatic coordinates of all of the displayable points are measured with the colorimeter, and therefore can be obtained with high accuracy, but the measurements of the chromatic coordinates take a long period of time.

Alternatively, some of the signals respectively corresponding to about 16.78 million displayable points may be selected and sequentially inputted to the liquid crystal display device so that chromatic coordinates of displayable points displayed on the liquid crystal panel are measured with the colorimeter. In this case, chromatic coordinates of displayable points near the displayable points obtained by the colorimeter are sequentially obtained by interpolation. In this manner, the correspondence between chromatic coordinates of about 16.78 million displayable points and signals may be obtained using measurements with the colorimeter in combination with interpolation. In this case, the chromatic coordinates of the displayable points obtained by interpolation are not as accurate as the chromatic coordinates obtained with the colorimeter, but the time to be taken in chromatic coordinate measurements can be reduced.

Figure 5:
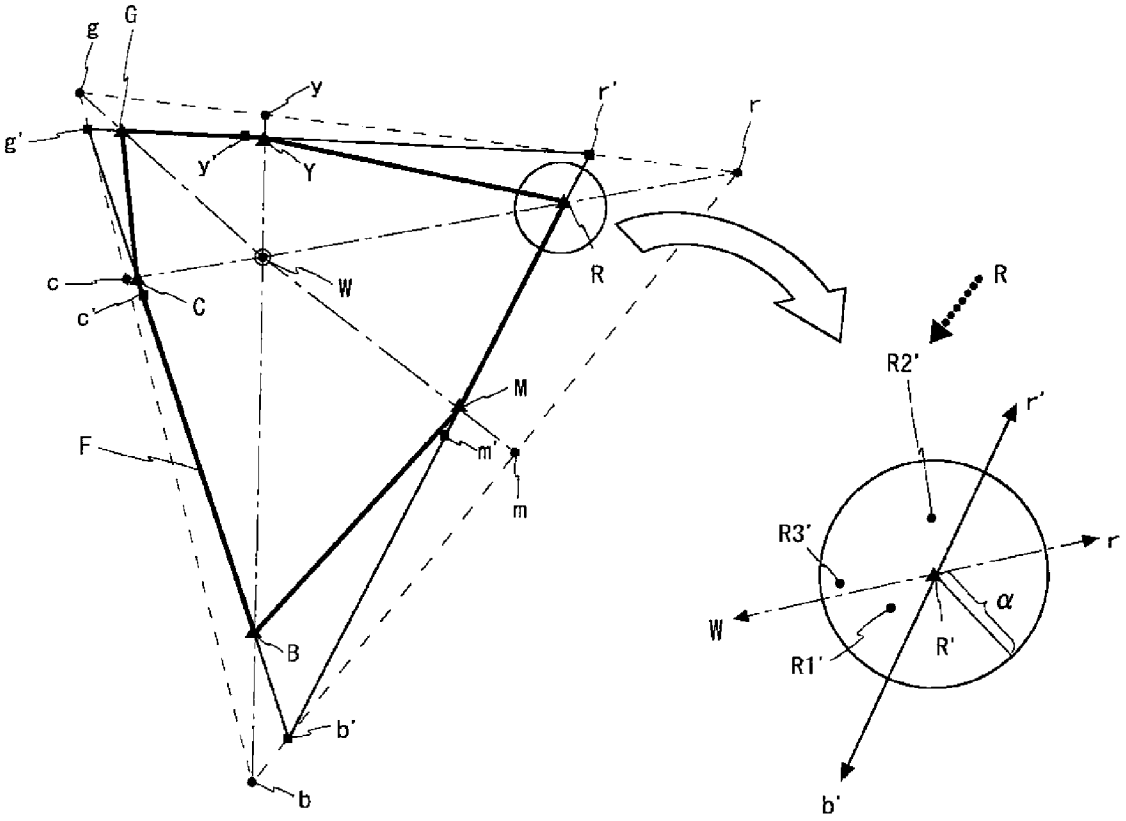
FIG. 5 is a diagram illustrating a method for obtaining the position of a pixel display point in the liquid crystal display device shown in FIG. 1.

Described next is a method for generating a correction signal CV representing a color which maintains the hue and the tone of a color expected from an input signal DV provided to the liquid crystal display device 10. FIG. 5 is a diagram illustrating a method for obtaining the position of a pixel display point on the basis of a primary-color chromaticity point, in which a portion of the chromaticity diagram shown in FIG. 4 is enlarged. In the following, a method for obtaining the position (chromatic coordinates) of pixel display point R displayed on the liquid crystal panel 11 will be described taking as an example the case where an input signal DV expected to represent red at primary-color chromaticity point r is provided to the liquid crystal display device 10. Note that chromaticity points r, y, g, c, b, and m shown in FIG. 4 are primary-color chromaticity points specifying primary colors red, yellow, green, cyan, blue, and magenta, respectively.

The input signal DV representing primary-color chromaticity point r is a signal with the red component at 255 and both of the green and blue components at 0. The red component is provided in the first subframe period, the green component in the second subframe period, and the blue component in the third subframe period. Note that in the following, an input signal DV with the red, green, and blue components at R, G, and B, respectively, may be represented as an input signal DV (R, G, B) for convenience.

Intersection R' is obtained, which is a point where straight line Wr, which extends between white point W and primary-color chromaticity point r, intersects side r'b' of triangle r'g'b', as shown in FIG. 5. When intersection R' coincides with any displayable point on side r'b', the coincident displayable point is set as pixel display point R. Note that any of the displayable points that can be displayed on the liquid crystal display device 10 will be referred to herein as pixel display points.

On the other hand, when intersection R' does not coincide with any displayable point, the liquid crystal display device 10 cannot display the color specified by intersection R'. Therefore, when intersection R' does not coincide with any displayable point, all displayable points within predetermined distance $\alpha$ from intersection R' are obtained. For example, three displayable points $R_{1'}$ to $R_{3'}$ are within distance $\alpha$ from intersection R' and included within triangle r'g'b', as shown in FIG. 5. In this case, of these three displayable points $R_{1'}$ to $R_{3'}$, the closest to intersection R' is displayable point $R_{1'}$. However, the displayable point that is the closest to primary-color chromaticity point r specified by the input signal DV (255, 0, 0) and is also close to intersection R' is displayable point $R_{2'}$. Therefore, displayable point $R_{2'}$ is set as pixel display point R specified by a correction signal CV corresponding to the input signal DV (255, 0, 0). In this case, the liquid crystal display device 10 can display an image in a color with substantially the same hue as the color specified by primary-color chromaticity point r.

Next, from the signals correlated to the chromatic coordinates of the displayable points obtained in advance, a signal corresponding to the chromatic coordinates of pixel display point R is selected and set as a correction signal CV. As a result, the correction signal CV specifying pixel display point R is correlated to the input signal DV (255, 0, 0).

Accordingly, when the input signal DV (255, 0, 0) specifying primary-color chromaticity point r is provided to the color correction circuit 15 in the liquid crystal display device 10, the color correction circuit 15 reads the correction signal CV correlated to the input signal DV (255, 0, 0) from the LUT 15*a*, and outputs it to the image signal line driver circuit 18. As a result, the liquid crystal panel 11 displays the color specified by pixel display point R.

Pixel display point R thus obtained is on or near straight line Wr extending between primary-color chromaticity point r and white point W, so that the color specified by pixel display point R has a hue of red or near red, which means that the hue is maintained.

However, the position of pixel display point R is on or near side r'b' of triangle r'g'b' and is closer to uncorrected chromaticity point b' than is uncorrected chromaticity point r'. Therefore, the color specified by pixel display point R is red mixed not only with green but also with blue. That is, to represent the color specified by pixel display point R, blue is required along with red and green. As a result, the color specified by pixel display point R has lower saturation than the color specified by uncorrected chromaticity point r'.

Likewise, for the input signal (255, 255, 0), which is expected to represent the primary color yellow corresponding to primary-color chromaticity point y, the input signal (0, 255, 0), which is expected to represent the primary color green corresponding to primary-color chromaticity point g, etc., chromatic coordinates of pixel display points G, B, and the like, displayed on the liquid crystal panel 11 are obtained. Hexagon F having vertices at pixel display points R, Y, G, C, B, and M thus obtained represents the range of color reproduction by the liquid crystal display device 10 according to the present embodiment. Therefore, the liquid crystal display device 10 can display colors specified by displayable points enclosed within hexagon F.

Figure 6:
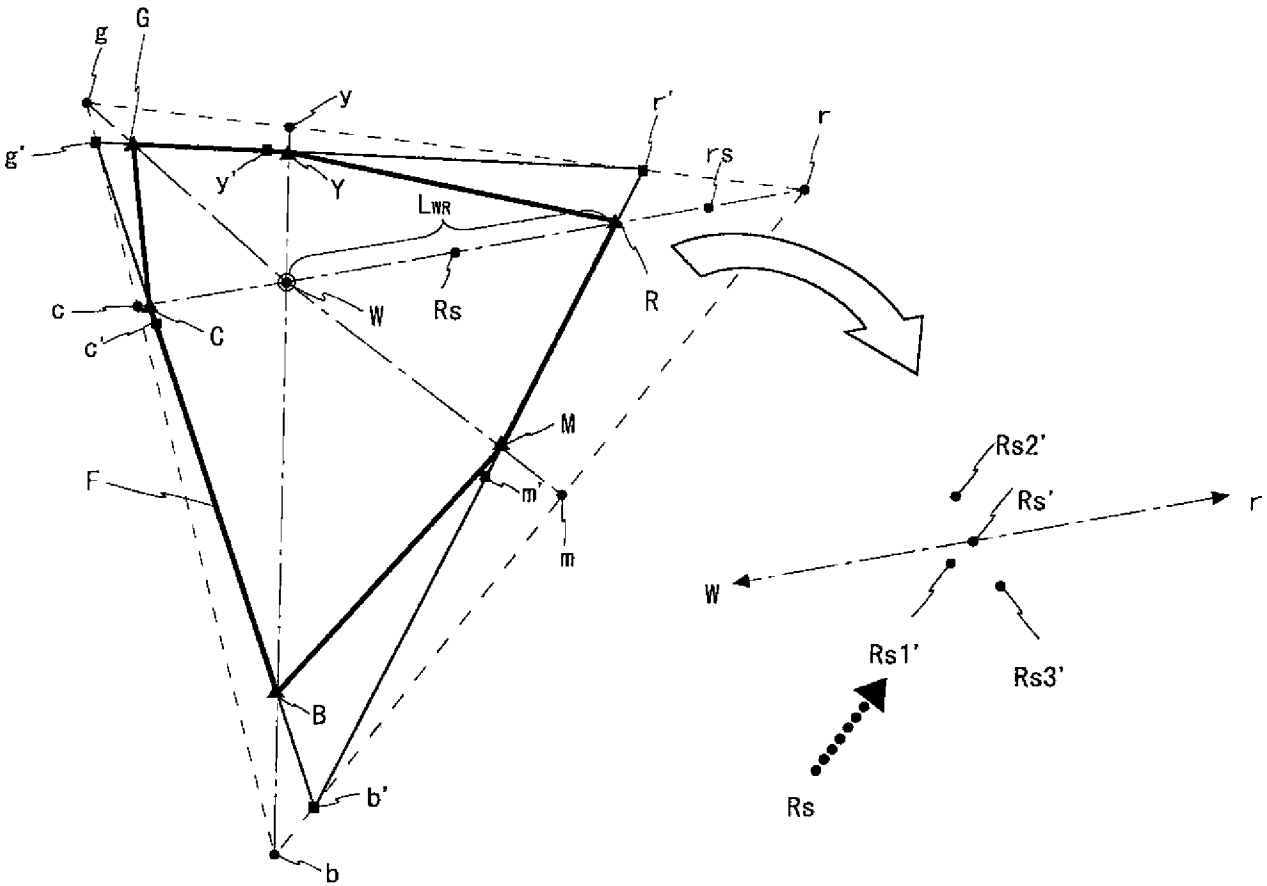
FIG. 6 is a diagram illustrating a method for obtaining the position of a pixel display point in the liquid crystal display device shown in FIG. 1.

Described next is a case where there is provided an input signal DV for a color desired to be displayed with the same hue as the color displayed at primary-color chromaticity point r, y, g, c, b, or m, the desired color component at its maximum level, and other color components greater than 0. FIG. 6 is a diagram illustrating a method for obtaining the position of a pixel display point maintaining the same hue and tone as a color at a primary-color chromaticity point, in which a portion of the chromaticity diagram shown in FIG. 4 is enlarged. A description will be given regarding a case where the input signal DV (255, a, a) (where a is an integer such that 1≤a≤254) having the red component at its maximum level, for example, is provided to the liquid crystal display device 10 as an input signal DV representing a chromaticity point as mentioned above. A chromaticity point for the color expected to be displayed in accordance with the input signal DV (255, a, a) will be set as chromaticity point rs.

Line Wr is set between white point W and primary-color chromaticity point r, as shown in FIG. 6. Since chromaticity point rs is on straight line Wr, the hue of the color specified by chromaticity point rs is red. The chromaticity point of the color to be displayed on the liquid crystal panel 11 when the input signal DV (255, a, a) is externally provided is set as temporary display point Rs'. To allow the color specified by temporary display point Rs' to have the hue of red as well, temporary display point Rs' should also be on straight line Wr. Next, to allow the color specified by temporary display point Rs' to maintain the tone of the color specified by display point rs, it is necessary to determine the position of temporary display point Rs' on straight line Wr. Specifically, the position of temporary display point Rs' in the chromaticity diagram is obtained on the basis of equation (1) below.

$$L_{WRs'}=L_{WR}\times(255-a)/255 \quad (1)$$

$L_{WRs'}$: the distance between white point W and temporary display point Rs'

$L_{WR}$: the distance between white point W and pixel display point R a: an integer such that 1≤a≤254

As shown in equation (1), the position of temporary display point Rs' is obtained by dividing the distance between white point W and pixel display point R into 255 equal parts and sequentially moving the distance in increments of one in the direction from white point W to pixel display point R. In the case where temporary display point Rs' thus obtained coincides with a displayable point on straight line Wr, it is set as pixel display point Rs corresponding to chromaticity point rs. In this case, the position of temporary display point Rs' can be readily obtained, so that the LUT 15*a* can be created with ease.

Furthermore, in the case where temporary display point Rs' does not coincide with any displayable point on straight line Wr, pixel display point Rs is obtained as follows. In the case where there are, for example, three displayable points $Rs_{1'}$, $Rs_{2'}$, and $Rs_{3'}$ close to temporary display point Rs', as shown in FIG. 6, displayable point $Rs_{1'}$, which is the closest of the three to temporary display point Rs' in the chromaticity diagram, is set as pixel display point Rs. In this case, the liquid crystal display device 10 can display an image in a color maintaining the hue and the tone of a color specified by a chromaticity point between white point W and primary-color chromaticity point r.

Next, from the signals correlated to the chromatic coordinates of the displayable points measured in advance, a signal corresponding to the chromatic coordinates of pixel display point Rs is selected and set as a correction signal CV. As a result, the correction signal CV specifying pixel display point Rs is correlated to the input signal DV.

Since pixel display point Rs is on or near straight line Wr, the hue of the color specified by pixel display point Rs is also red. Moreover, according to equation (1), the lower the values of color components of the input signal DV other than the red component, the further the distance $L_{WRs'}$ from white point W, and therefore the correction signal CV specifying pixel display point Rs maintains the tone. Note that since pixel display point Rs is positioned within hexagon F inside chromaticity point rs, the saturation of the color specified by pixel display point Rs is lower than that of the color specified by chromaticity point rs.

Likewise, correction signals CV correlated to input signals DV for the hue of red with the green and blue components in the range from 1 to 255, correction signals CV correlated to input signals DV for the hue of yellow with the blue component in the range from 1 to 255, and correction signals CV correlated to input signals DV for the hue of green with the red and blue components in the range from 1 to 255 are sequentially obtained, and other correction signals CV are also obtained in a sequence up to correction signals CV correlated to input signals DV for the hue of magenta with the green component in the range from 1 to 255.

Correction signals CV corresponding to all pixel display points for the hues of red, yellow, green, cyan, blue, and magenta may be obtained by the aforementioned method, or correction signals CV corresponding to only an appropriately selected group of the pixel display points for the hues may be obtained. In either case, the obtained correction signals CV are stored to the LUT 15*a* in correlation with input signals DV. Note that in the case where correction signals CV are obtained only for the selected pixel display points using the aforementioned method, the color correction circuit 15 reads necessary correction signals CV from among the correction signals CV stored in the LUT 15*a*, and obtains correction signals CV corresponding to unselected pixel display points by interpolation. Then, the obtained correction signals CV are outputted to the image signal line driver circuit 18. In this manner, only the correction signals CV corresponding to appropriately selected pixel display points are stored in the LUT 15*a*, thereby reducing the memory capacity of the LUT 15*a* compared to the case where all correction signals CV are stored. Moreover, the color correction circuit 15 also obtains correction signals CV corresponding to pixel display points specifying colors other than the hues of red, yellow, green, cyan, blue, and magenta, by interpolation on the basis of the correction signals CV stored in the LUT 15*a*, and outputs the obtained correction signals CV to the image signal line driver circuit 18.

FIG. 7 is a diagram illustrating the configuration of the LUT 15*a*. Listed in the right column of FIG. 7 are the red, green, and blue components of the correction signals CV corresponding to the pixel display points obtained by the aforementioned method. As can be appreciated from the foregoing, these pixel display points are displayable points, each being selected for one temporary display point determined by computation, from among the measured displayable points. Listed in the left column of FIG. 7 are the red, green, and blue components of the input signals DV corresponding to the correction signals obtained by computation. Note that the LUT 15*a* shown in FIG. 7 only lists the correspondence between the input signals DV and the correction signals CV corresponding to the temperature information provided by the thermometer 19 for specific temperatures, and omits the correspondence for other temperatures.

In the foregoing, the correspondence between the input signals DV and the correction signals CV is obtained using white point W specified by the input signal DV (255, 255, 255). However, a correction signal CV corresponding to an input signal DV may be obtained and additionally stored to the LUT 15*a*, using a point specified by an input signal (w, w, w) (where w is an integer such that $0 \leq w \leq 254$) in place of white point W.

Figure 8:
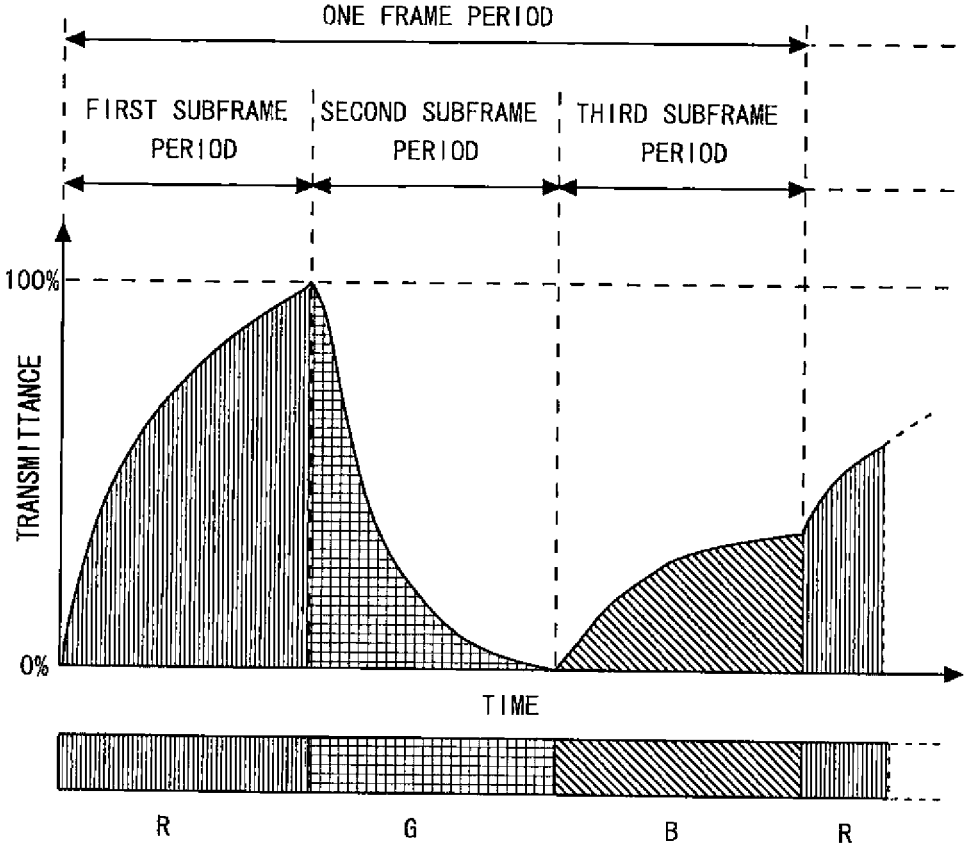
FIG. 8 is a diagram illustrating the luminance of the liquid crystal panel for each subframe period where the liquid crystal display device shown in FIG. 1 displays a red still image.

FIG. 8 is a diagram illustrating the luminance of the liquid crystal panel 11 for each subframe period where the liquid crystal display device 10 shown in FIG. 1 is used to display a red still image, in which the horizontal axis represents time and the vertical axis represents the transmittance of the liquid crystal panel 11. As shown in FIG. 8, the red LEDs 20*r* emit light in the first subframe period, the green LEDs 20*g* emit light in the second subframe period, and the blue LEDs 20*b* emit light in the third subframe period. Here, in the first and second subframe periods, the change in the transmittance of the liquid crystal panel 11 is the same as the change in the transmittance of the liquid crystal panel shown in FIG. 19, and therefore any description thereof will be omitted.

Figure 19:
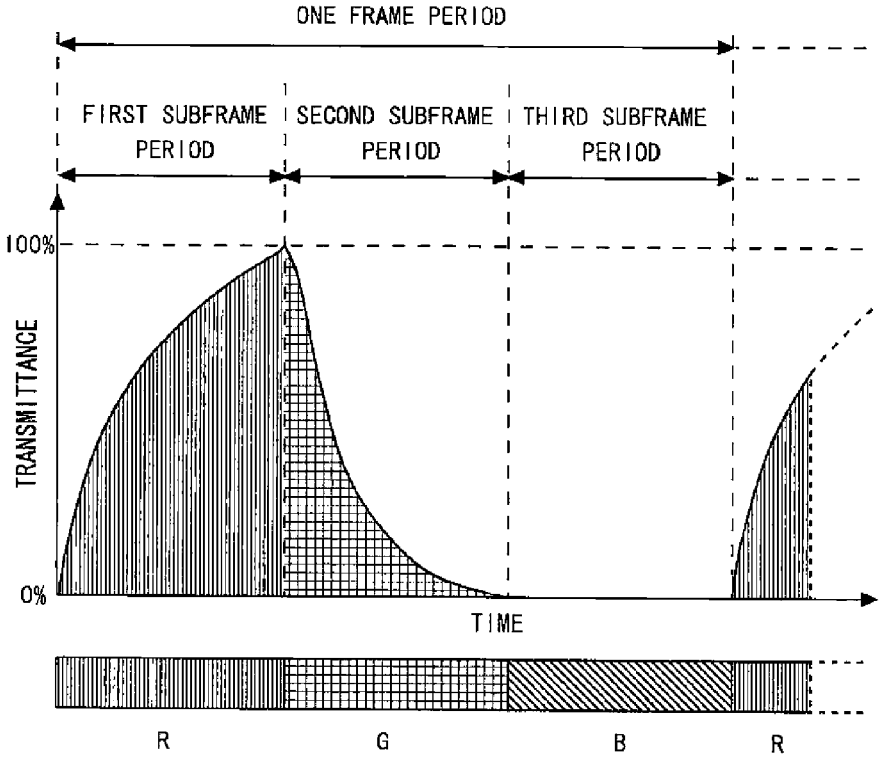
FIG. 19 is a diagram illustrating the luminance of a liquid crystal panel for each subframe period where a conventional liquid crystal display device displays a red still image.

In the third subframe period, the transmittance of the liquid crystal panel is conventionally at 0%, as shown in FIG. 19, so that blue light emitted by the blue LEDs 20*b* is blocked. However, to allow the liquid crystal display device 10 to display red specified by pixel display point R, not only the red image but also green and blue images are required to be displayed, as described earlier.

Therefore, to display a blue image in the third subframe period, the blue component included in the correction signal CV is also required to be set to a value corresponding to the chromatic coordinates of pixel display point R, thereby setting the transmittance of the liquid crystal panel 11 to a predetermined value in the third subframe period. As a result, blue light emitted by the blue LEDs 20*b* is transmitted in part through the liquid crystal panel 11, so that a blue image is displayed as well. In this case, the saturation of red displayed on the liquid crystal panel 11 (red specified by pixel display point R) is lower than the saturation of red expected from the input signal DV (red specified by primary-color chromaticity point r). However, the image displayed on the liquid crystal panel 11 maintains the same or almost the same hue as the hue of red expected from the input signal DV. Moreover, as is apparent from the method for obtaining the correction signal CV, the tone of the color represented by the correction signal CV is also maintained.

1.3 LUT Creation Method

The LUT 15*a* is created in advance using a PC (personal computer), and incorporated in the color correction circuit 15 of the liquid crystal display device 10. The configuration of the PC to be used for creating the LUT 15*a* will therefore be described.

Figure 9:
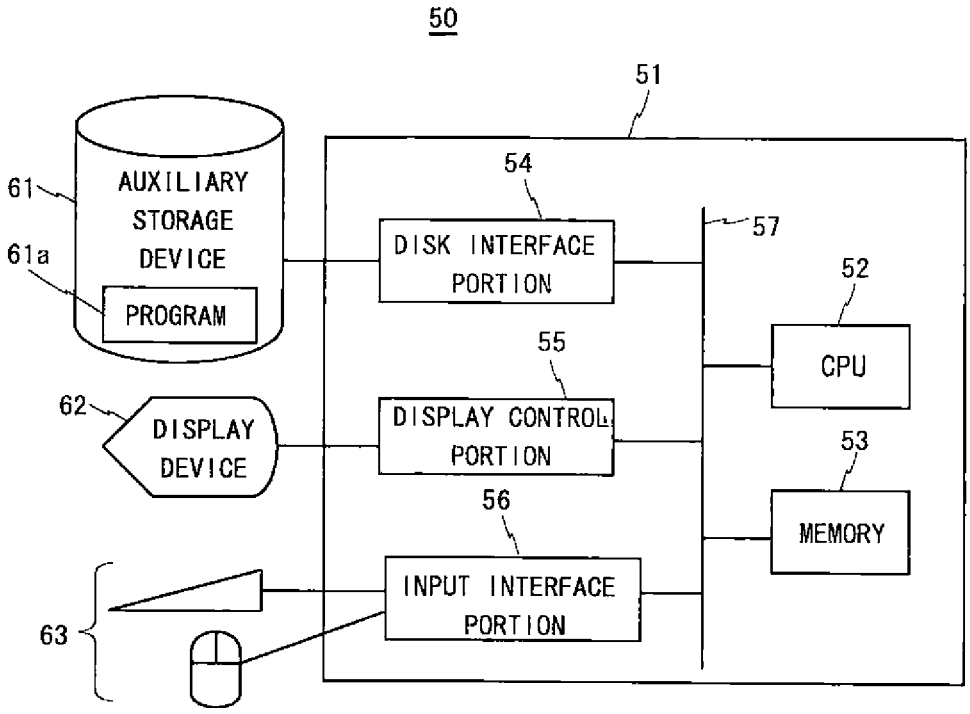
FIG. 9 is a block diagram illustrating the hardware configuration of a PC to be used for creating the LUT included in the liquid crystal display device shown in FIG. 1.

FIG. 9 is a block diagram illustrating the hardware configuration of the PC 50 to be used for creating the LUT 15*a*. The PC 50 includes a main unit 51, an auxiliary storage device 61, a display device 62 such as a CRT, and input devices 63 such as a keyboard and a mouse, as shown in FIG. 9. The main unit 51 of the PC 50 includes a CPU 52, memory 53 such as RAM or ROM, a disk interface portion 54, a display control portion 55, and an input interface portion 56. Both the CPU 52 and the memory 53 are directly connected to a bus line 57. The auxiliary storage device 61, the display device 62, and the input devices 63, such as a keyboard and a mouse, are connected to the bus line 57 via the disk interface portion 54, the display control portion 55, and the input interface portion 56, respectively. The auxiliary storage device 61 has stored therein a program 61*a* for creating the LUT 15*a*, and the program 61*a* is loaded to the memory 53 when the PC 50 starts operating. The process of creating the LUT 15*a* is started by the CPU 52 executing the program 61*a*.

Figure 10:
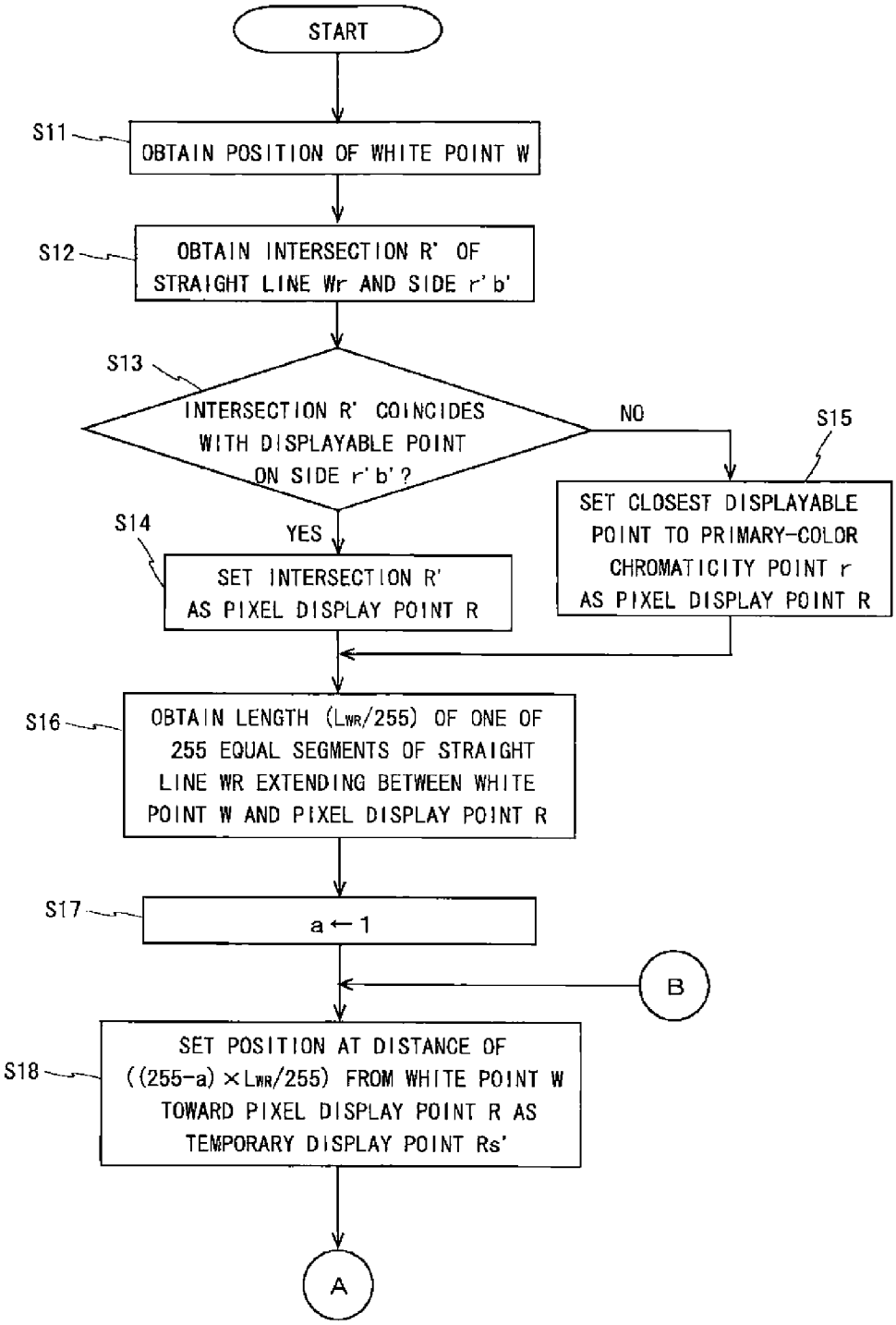
FIG. 10 is a flowchart illustrating a method for creating parts of the LUT included in the liquid crystal display device shown in FIG. 1.
Figure 11:
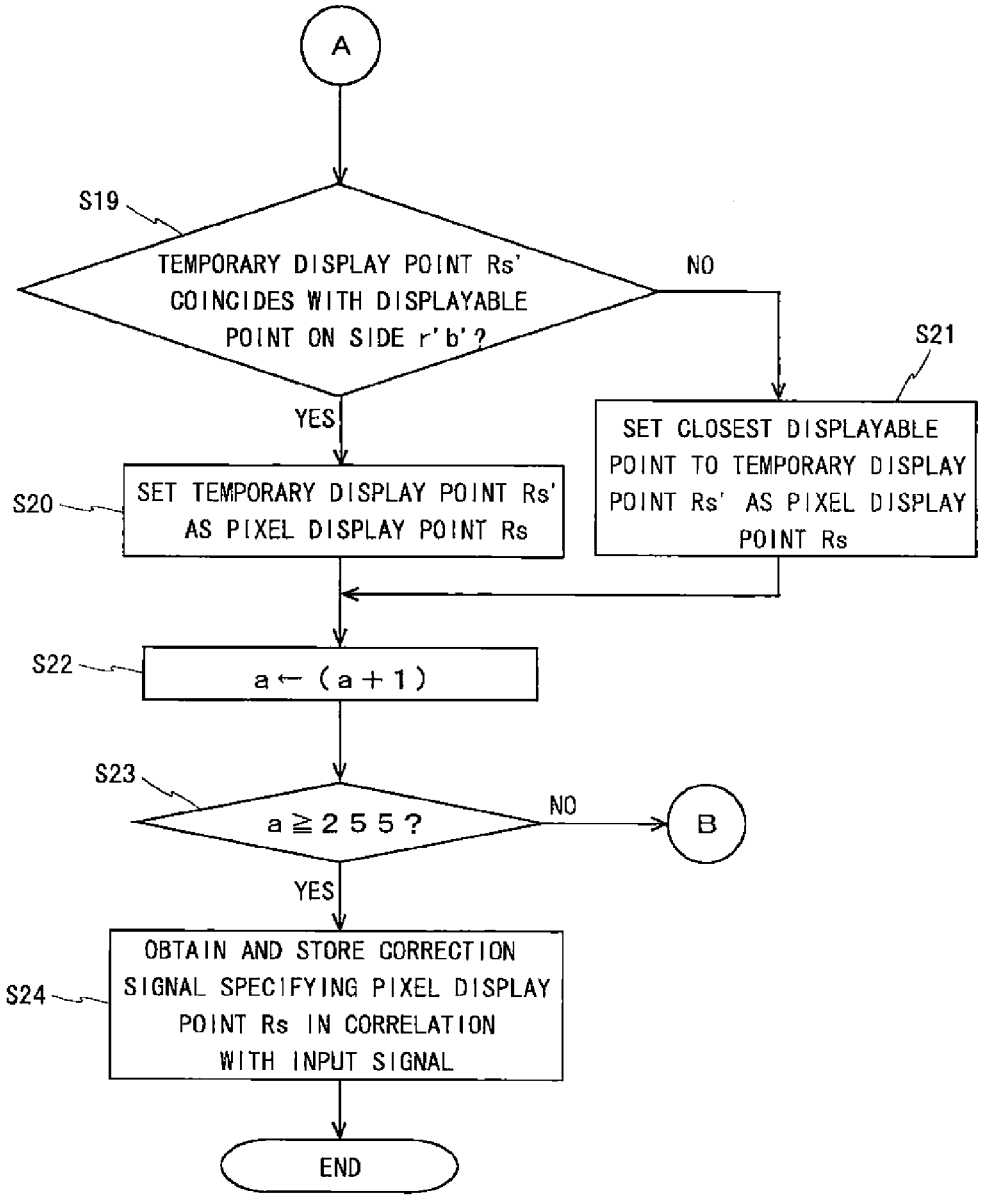
FIG. 11 is a flowchart illustrating the method for creating parts of the LUT included in the liquid crystal display device shown in FIG. 1.

FIGS. 10 and 11 are flowcharts illustrating a method for creating parts of the LUT 15*a*. Here, the method for creating the LUT 15*a* will be described in which an input signal DV for the hue of red with the red component in the range from 1 to 255 is converted to a correction signal CV maintaining the hue and tone. The CPU 52 initially obtains the position of white point W with all of the red, green, and blue components of the input signal DV being at 255 (step S11). Next, the CPU 52 obtains chromatic coordinates of intersection R' of straight line Wr, which extends between primary-color chromaticity point r and white point W, and side r'b' of triangle r'g'b' (step S12).

The CPU 52 determines whether or not intersection R' coincides with any displayable point on side r'b' (step S13). When intersection R' is determined to coincide with any displayable point on side r'b', the process advances to step S14. Then, the CPU 52 sets intersection R' as pixel display point R corresponding to primary-color chromaticity point r (step S14). Alternatively, when intersection R' is not determined to coincide with any displayable point on side r'b', the process advances to step S15. Then, the CPU 52 sets one of the displayable points within predetermined distance $\alpha$ from intersection R' as pixel display point R, the displayable point being enclosed within triangle r'g'b' and also being the closest to primary-color chromaticity point r (step S15). Note that pixel display point R may be a displayable point which is closer to white point W than intersection R' and is near straight line Wr in the chromaticity diagram shown in FIG. 4.

The CPU 52 obtains the length ($L_R$/255) of one of the 255 equal segments of straight line WR extending between white point W and pixel display point R (step S16). Next, variable a is set to 1 (step S17), and a position at a distance of ((255−a)×$L_R$/255) from white point W toward pixel display point R is set as temporary display point Rs' corresponding to chromaticity point rs (step S18). Note that the length of the segment to be used for obtaining temporary display point Rs' may be the length of a segment obtained by dividing straight line WR, which extends between white point W and pixel display point R, into 255 parts at an arbitrary ratio, rather than the length of one of the 255 equal segments of straight line WR.

The CPU 52 determines whether or not temporary display point Rs' obtained in step S18 coincides with any displayable point on straight line Wr (step S19). When temporary display point Rs' is determined to coincide with any displayable point on straight line Wr, the process advances to step S20. Then, the CPU 52 sets the coincident displayable point as pixel display point Rs corresponding to chromaticity point rs (step S20). Alternatively, when temporary display point Rs' is not determined to coincide with any displayable point on straight line Wr, the process advances to step S21. Then, the CPU 52 obtains the closest displayable point to temporary point Rs' within triangle r'g'b', and sets the obtained displayable point as pixel display point Rs (step S21).

The CPU 52 increments the value of variable a by 1 (step S22), and determines whether or not variable a is 255 or higher (step S23). When variable a is determined to be 254 or lower, the process returns to step S18, and when variable a is determined to be 255 or higher, the process advances to step S24. The CPU 52 obtains a correction signal CV specifying pixel display point Rs, and stores it to the LUT 15*a* in correlation with an input signal DV (step S24).

In this manner, a correction signal CV that specifies pixel display point R corresponding to primary-color chromaticity point r, and correction signals CV specifying pixel display points Rs obtained on the basis of input signals DV for the hue of red with color components other than the red component in the range from 1 to 254, are obtained and stored to the LUT 15*a* in correlation with input signals DV. Similarly, for each of the hues of yellow, green, cyan, blue, and magenta, correction signals CV maintaining the hues and the tones are obtained and stored to the LUT 15*a* in correlation with input signals DV. In addition, correction signals CV specifying colors other than the hues of red, yellow, green, cyan, blue, and magenta are sequentially obtained by interpolation on the basis of the correction signals CV, and stored to the LUT 15*a* in correlation with input signals DV. This completes the creation of the LUT 15*a*. Note that in the present embodiment, the pixel display points Rs on straight line WR are sequentially obtained in the direction from white point W to pixel display point R. However, pixel display points Rs on straight line WR may be sequentially obtained in the direction from pixel display point R to white point W.

1.4 Effect

As described above, the LUT 15*a* of the liquid crystal display device 10 according to the present embodiment has correction signals CV stored therein in correlation with input signals DV, the correction signals CV specifying colors that maintain hues and tones of colors expected to be displayed in accordance with the input signals DV. Accordingly, when an input signal DV is provided to the liquid crystal display device 10, the color signal processing circuit 14 can read a correction signal CV correlated to the input signal DV from the LUT 15*a* in real-time. Thus, the liquid crystal display device 10 can display an image on the liquid crystal panel in a color maintaining the hue and the tone of a color expected to be displayed in accordance with the input signal DV.

1.5 Variant

A liquid crystal display device according to a variant of the first embodiment will be described. In this variation, correction signals CV correlated to input signals DV representing hues of red, green, and blue are obtained by computation, and correction signals CV correlated to input signals DV representing other colors, including hues of yellow, cyan, and magenta, are obtained by interpolation. Thus, the number of correction signals CV to be obtained by computation is reduced, so that the LUT 15*a* can be created with ease.

2. Second Embodiment

A liquid crystal display device according to a second embodiment will be described. The configuration of the liquid crystal display device according to the present embodiment is the same as the configuration of the liquid crystal display device 10 shown in FIG. 1, and therefore any illustration and description thereof will be omitted. In the present embodiment, pixel display points on each side of hexagon F shown in FIG. 4 are obtained by computation, along with the pixel display points obtained by computation in the first embodiment. Accordingly, a description will be given taking as an example the case where pixel display points on side RY, one of the sides of hexagon F, are obtained.

The input signal DV (255, 0, 0) expected to represent the primary color red corresponding to primary-color chromaticity point r and the input signal DV (255, 255, 0) expected to represent the primary color yellow corresponding to primary-color chromaticity point y are the same except for the green component. From this, it can be appreciated that there are 254 pixel display points which are different in their green components between primary-color chromaticity points r and y. Accordingly, 254 pixel display points between pixel display points R and Y are obtained. A chromaticity diagram showing the range of color reproduction by the liquid crystal display device of the present embodiment in a u'v' coordinate system is the same as the chromaticity diagram shown in FIG. 4, and therefore is not shown.

Figure 12:
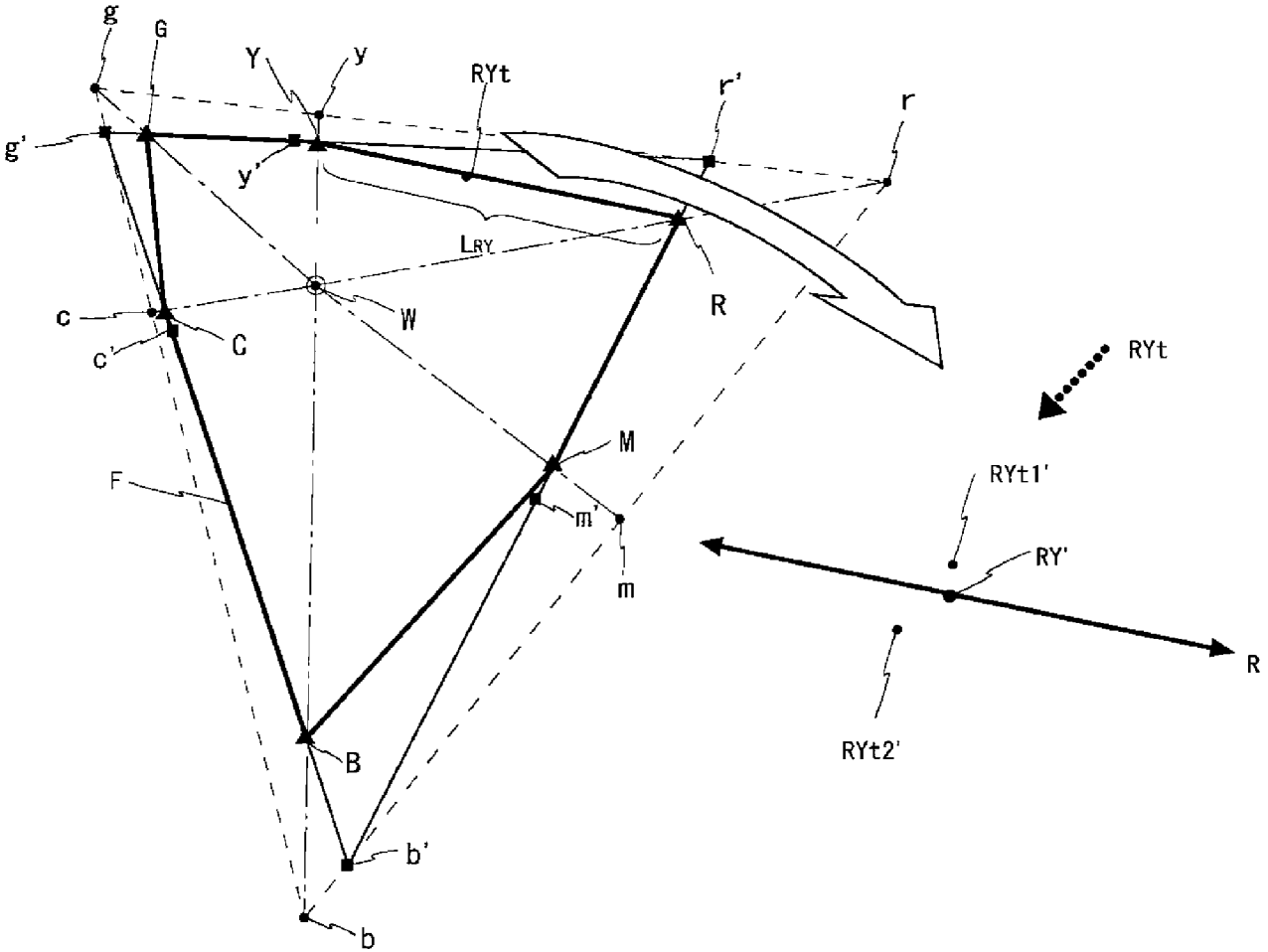
FIG. 12 is a diagram illustrating a method for obtaining the position of a pixel display point in a liquid crystal display device according to a second embodiment.

Described next is a method for obtaining the 254 pixel display points on side RY which are different in their green components. FIG. 12 is a diagram illustrating a method for obtaining the position of a pixel display point on side RY of hexagon F shown in FIG. 4, in which a portion of the chromaticity diagram shown in FIG. 4 is enlarged.

Line RY is set between pixel display points R and Y, as shown in FIG. 12. Note that the method for obtaining pixel display points R and Y is the same as in the first embodiment, and therefore any description thereof will be omitted. Temporary display point RYt' is on straight line RY. Next, to allow the color specified by temporary display point RYt' to maintain the tone, it is necessary to determine the position of temporary display point RYt' on straight line RY. Specifically, the position of temporary display point RYt' in the chromaticity diagram is obtained on the basis of equation (2) below.

$$L_{RYt'}=L_{RY}\times t/255 \quad (2)$$

$L_{RYt'}$: the distance between pixel display point R and temporary display point RYt'

$L_{RY}$: the distance between pixel display points R and Y t: an integer such that $1 \leq t \leq 254$ As shown in equation (2), the chromatic coordinates of temporary display point RYt' are obtained by dividing the distance between pixel display points R and Y into 255 equal parts and sequentially moving the distance in increments of one ($L_{RY}/255$) in the direction from pixel display point R to pixel display point Y. In the case where temporary display point RYt' thus obtained coincides with a displayable point on straight line RY, it is set as pixel display point RYt. In this case, the position of temporary display point RYt' can be readily obtained, so that the LUT 15*a* can be created with ease.

Furthermore, in the case where temporary display point RYt' does not coincide with any displayable point on straight line RY, pixel display point RYt is obtained as follows. In the case where there are, for example, two displayable points $RYt_{1'}$ and $RYt_{2'}$, close to temporary display point RYt', as shown in FIG. 12, displayable point $RYt_{1'}$, which is the closer of the two to temporary display point RYt', is set as pixel display point RYt. In this case, the liquid crystal display device 10 can display an image in a color having substantially the same hue as and the same tone as a color specified by a chromaticity point between primary-color chromaticity points r and y.

Next, from the signals correlated to the chromatic coordinates of the displayable points obtained in advance for each pixel display point RYt, a signal corresponding to the chromatic coordinates of the pixel display point RYt is selected and set as a correction signal CV. As a result, the correction signal CV representing the pixel display point RYt is added to the LUT 15*a* in correlation with the input signal DV.

Correction signals CV corresponding to all pixel display points on or near straight lines extending between adjacent pixel display points R, Y, G, C, B, and M, such as straight line RY, may be obtained by the aforementioned method, or correction signals CV corresponding to only an appropriately selected group of the pixel display points may be obtained. In either case, the obtained correction signals CV are stored to the LUT 15*a* in correlation with input signals DV. Note that in the case where correction signals CV are obtained only for the selected pixel display points using the aforementioned method, the color correction circuit 15 reads necessary correction signals CV from among the correction signals CV stored in the LUT 15*a*, and obtains correction signals CV corresponding to unselected pixel display points by interpolation. Then, the obtained correction signals CV are outputted to the image signal line driver circuit 18. In this manner, only the correction signals CV corresponding to appropriately selected pixel display points are stored in the LUT 15*a*, thereby reducing the memory capacity of the LUT 15*a* compared to the case where all correction signals CV are stored.

FIG. 13 is a diagram illustrating the configuration of the LUT 15*a*. In addition to the correction signals CV obtained in the first embodiment, the LUT 15*a* includes the correction signals CV obtained in the present embodiment in correlation with their respective input signals DV, as shown in FIG. 13.

According to equation (2), the greater the value of the green component of the input signal DV, the further the distance $L_{RYt}$ from pixel display point R to pixel display point RYt, and therefore the correction signal CV specifying pixel display point RYt maintains the tone. Note that since pixel display points R and Y are positioned within hexagon F inside primary-color chromaticity points r and y, the saturation of the color specified by pixel display point RYt on or near straight line RY is reduced.

Similarly, thereafter, correction signals CV specifying 254 pixel display points YGt between pixel display points Y and G, and correction signals CV specifying 254 pixel display points GCt between pixel display points G and C are sequentially obtained, and other correction signals CV are also obtained in a sequence up to correction signals CV specifying 254 pixel display points MRt between pixel display points M and R. Thereafter, the obtained correction signals CV are added to the LUT 15*a* in correlation with input signals DV.

Figure 14:
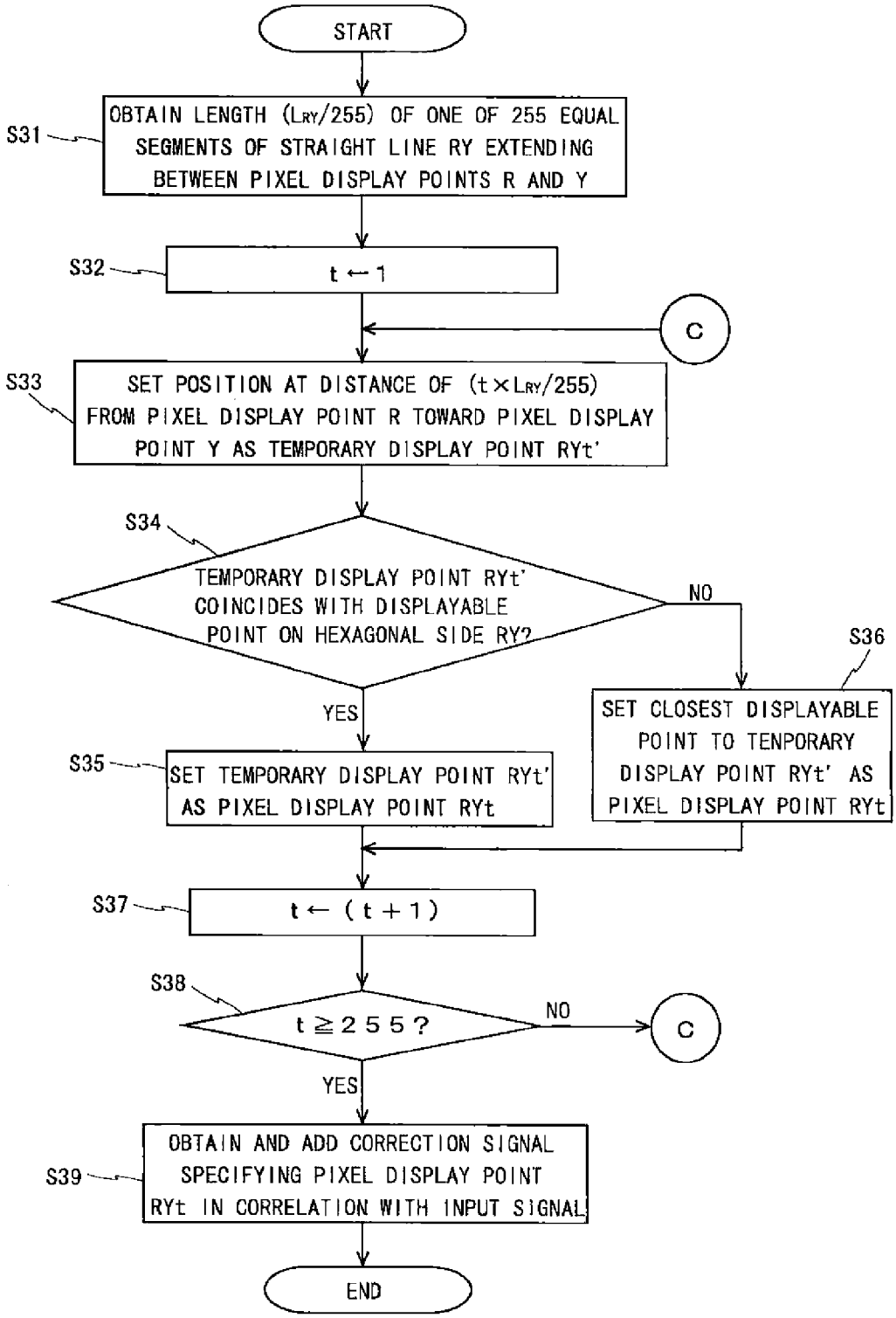
FIG. 14 is a flowchart illustrating a method for creating parts of the LUT included in the liquid crystal display device according to the second embodiment.

The LUT 15*a* of the present embodiment is created using the PC 50 shown in FIG. 9. FIG. 14 is a flowchart illustrating a method for creating parts of the LUT 15*a* included in the present embodiment. Here, a description will be given taking as an example a method for obtaining chromatic coordinates of pixel display point RYt on straight line RY extending between pixel display points R and Y.

The CPU 52 obtains the length ($L_{RY}/255$) of one of the 255 equal segments of straight line RY extending between pixel display points R and Y (step S31). In step S32, variable t is set to 1. A position at a distance of ($t \times L_{RY}/255$) from pixel display point R toward pixel display point Y is set as temporary display point RYt' (step S33). Note that the length of the segment to be used for obtaining temporary display point RYt' may be the length of a segment obtained by dividing straight line RY, which extends between pixel display points R and Y, into 255 parts at an arbitrary ratio, rather than the length of one of the 255 equal segments of straight line RY.

The CPU 52 determines whether or not temporary display point RYt' obtained in step S33 coincides with any displayable point on side RY of hexagon F (step S34). When the CPU 52 determines temporary display point RYt' to coincide with any displayable point on side RY, the process advances to step S35. Then, the CPU 52 sets the coincident displayable point as pixel display point RYt (step S35). Alternatively, when temporary display point RYt' is not determined to coincide with any displayable point on side RY in step S34, the process advances to step S36. Then, the CPU 52 obtains the closest displayable point to temporary display point RYt', and sets the obtained displayable point as pixel display point RYt (step S36).

The CPU 52 increments the value of variable t by 1 (step S37), and determines whether or not variable t is 255 or higher (step S38). When variable t is determined to be 254 or lower, the process returns to step S33, and when variable t is determined to be 255 or higher, the process advances to step S39. The CPU 52 obtains a correction signal CV specifying pixel display point RYt, and adds it to the LUT 15*a* in correlation with an input signal DV (step S39).

Similarly, correction signals CV specifying pixel display points on sides YG, GC, CB, BM, and MR of hexagon F are obtained and added to the LUT 15*a* in correlation with input signals DV. This completes the creation of the LUT 15*a*. Note that in the present embodiment, chromatic coordinates of pixel display points RYt on side RY are sequentially obtained in the direction from pixel display point R to pixel display point Y. However, the chromatic coordinates of pixel display points RYt on side RY may be sequentially obtained in the direction from pixel display point Y to pixel display point R.

As described above, the liquid crystal display device 10 can display an image in a color maintaining the hue and the tone of a color specified by a chromaticity point between primary-color chromaticity points r and y. Moreover, in addition to the correction signals CV obtained in the first embodiment, correction signals CV specifying pixel display points on the sides of hexagon F are further obtained by computation. Such correction signals CV obtained by computation render it possible to display images in colors maintaining the hues and the tones of colors expected from input signals DV with higher accuracy compared to correction signals CV obtained by interpolation.

3. Third Embodiment

A liquid crystal display device according to a third embodiment will be described. The configuration of the liquid crystal display device according to the present embodiment is the same as the configuration of the liquid crystal display device 10 shown in FIG. 1, and therefore any illustration and description thereof will be omitted.

Figure 15:
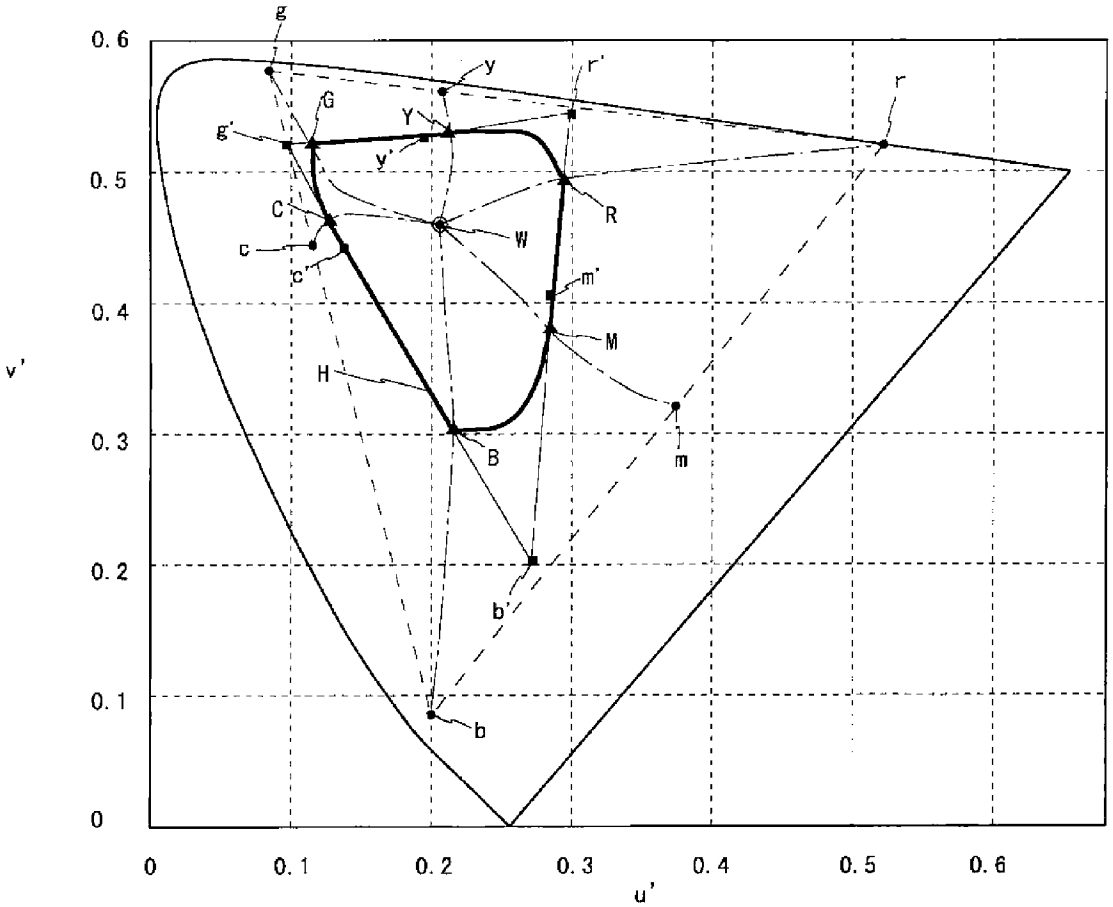
FIG. 15 is a chromaticity diagram showing the range of color reproduction by a liquid crystal display device according to a third embodiment in a u'v' coordinate system.

FIG. 15 is a chromaticity diagram showing the range of color reproduction by the liquid crystal display device of the present embodiment in a u'v' coordinate system. As shown in FIG. 15, smooth curves connect primary-color chromaticity points r, y, g, c, b, and m to white point W. These curves respectively pass pixel display points R, Y, G, C, B, and M corresponding to their respective primary-color chromaticity points r, y, g, c, b, and m. Next, input signals DV are converted to correction signals CV specifying pixel display points that correspond to 255 equal parts for each curve. As a result, pixel display points R, Y, G, C, B, and M are obtained, which specify colors maintaining the hues and the tones of colors expected to be displayed in accordance with the input signals DV. Graphic H obtained by sequentially connecting pixel display points R, Y, G, C, B, and M by the method as described in the present embodiment has a curved periphery. Note that the method for obtaining pixel display points R, Y, G, C, B, and M is the same method as described in the first embodiment, and therefore any description thereof will be omitted.

Figure 16:
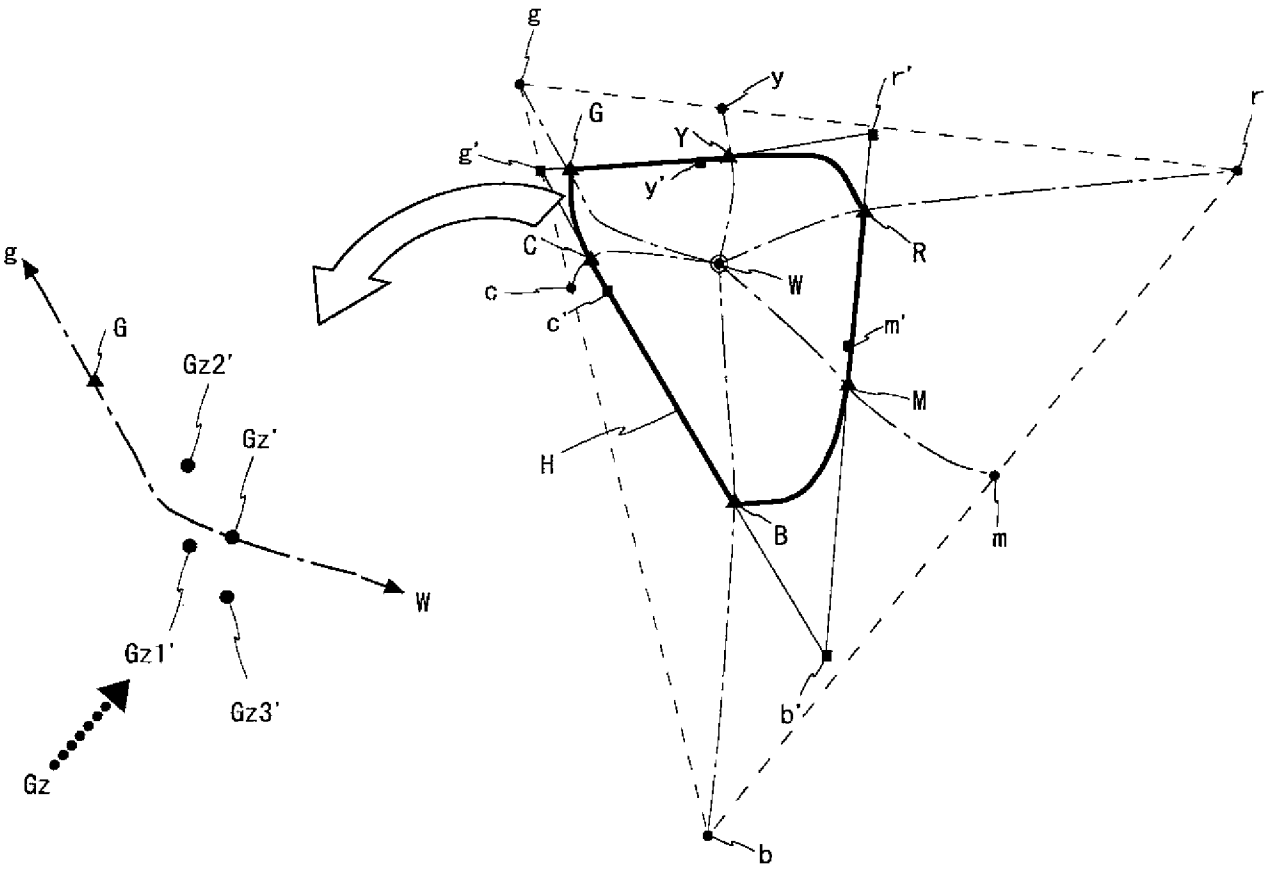
FIG. 16 is a diagram illustrating a method for obtaining the position of a pixel display point in the liquid crystal display device according to the third embodiment.

A method for obtaining pixel display point Gz will be described where there is provided an input signal DV for the hue of green with the green component at its maximum level and other color components greater than 0. FIG. 16 is a diagram illustrating a method for obtaining the position of pixel display point Gz on the basis of, for example, chromaticity point gz with the green component at its maximum level, in which a portion of the chromaticity diagram shown in FIG. 15 is enlarged. Primary-color chromaticity point g and white point W are connected by smooth curve Wg passing through pixel display point G, as shown in FIG. 16. Chromaticity point gz is on curve Wg, and therefore the hue of the color specified by chromaticity point gz is green. When the input signal DV (d, 255, d) (where d is an integer such that $1 \leq d \leq 254$) is externally provided, the chromaticity point for the color to be displayed on the liquid crystal panel 11 is set as temporary display point Gz'. To allow the color specified by temporary display point Gz' to have the hue of green as well, temporary display point Gz' should also be on curve Wg. Next, to allow the color specified by temporary display point Gz' to maintain the tone of the color specified by display point gz, it is necessary to determine the position of temporary display point Gz' on curve Wg. Specifically, the position of temporary display point Gz' in the chromaticity diagram is obtained on the basis of equation (3) below.

$$K_{WGz'}=K_{WG}\times(255-d)/255 \quad (3)$$

$K_{WGz'}$: the distance between white point W and temporary display point Gz' along the curve $K_{WG}$: the distance between white point W and pixel display point G along the curve d: an integer such that $1 \leq d \leq 254$ As shown in equation (3), the chromatic coordinates of temporary display point Gz' are obtained by dividing the distance between white point W and pixel display point G into 255 equal parts along curve Wg and sequentially moving the distance in increments of one in the direction from white point W to pixel display point G. In the case where temporary display point Gz' thus obtained coincides with a displayable point on curve Wg, it is set as pixel display point Gz corresponding to chromaticity point gz. In this case, the position of temporary display point Gz' can be readily obtained, so that the LUT 15*a* can be created with ease.

Furthermore, in the case where temporary display point Gz' does not coincide with any displayable point on curve Wg, the closest displayable point to temporary display point Gz' is set as pixel display point Gz. The method for obtaining such a pixel display point Gz is the same as the method for obtaining pixel display point Rs on the basis of temporary display point Rs' in the first embodiment, and therefore any detailed description thereof will be omitted. Thereafter, from the signals correlated to the chromatic coordinates of the displayable points obtained in advance, a signal corresponding to the chromatic coordinates of pixel display point Gz is selected and set as a correction signal CV. As a result, the correction signal CV specifying pixel display point Gz is correlated to the input signal DV (d, 255, d).

Figure 17:
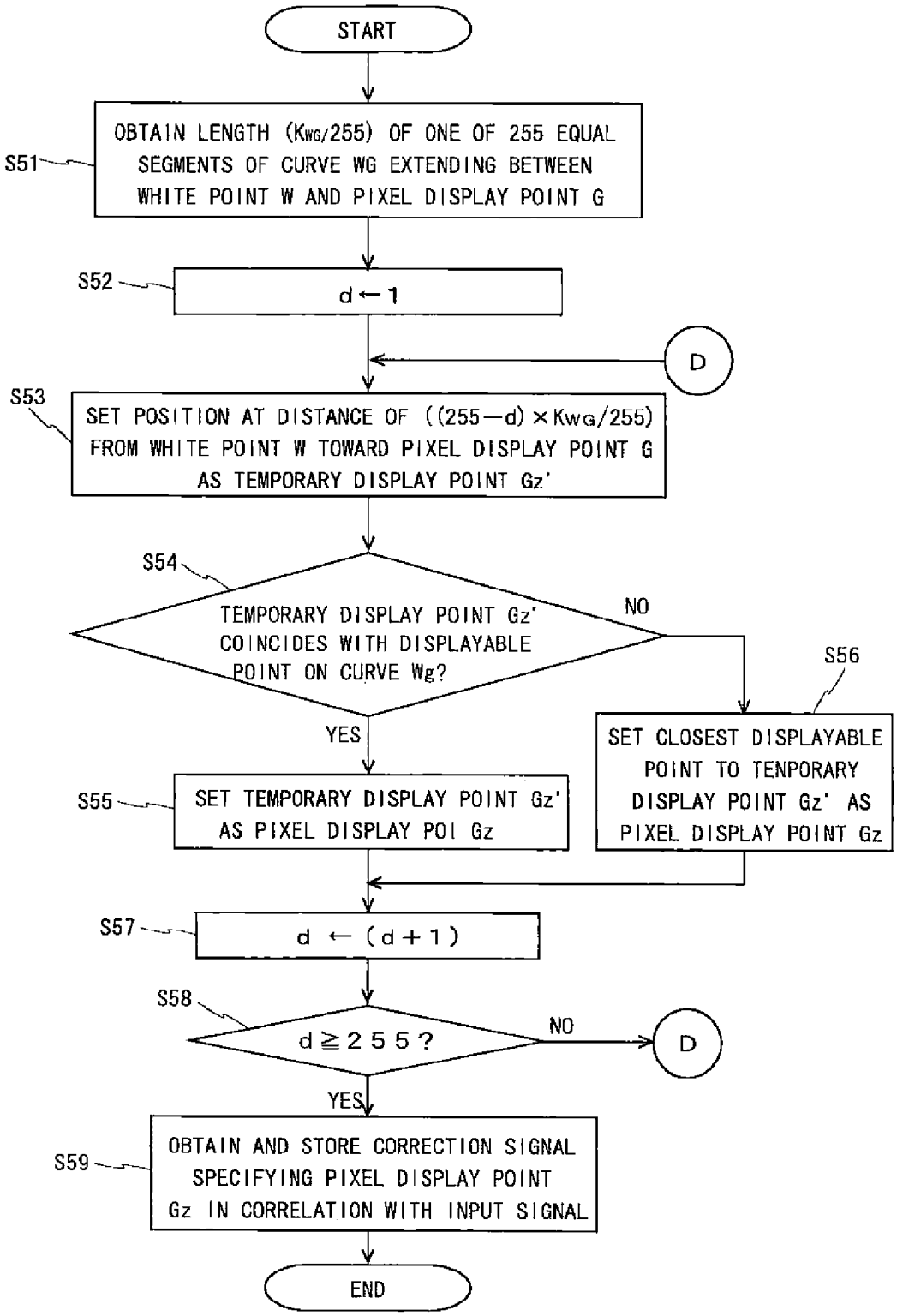
FIG. 17 is a flowchart illustrating a method for creating parts of an LUT included in the liquid crystal display device according to the third embodiment.

The LUT 15*a* of the present embodiment is created using the PC 50 shown in FIG. 9. FIG. 17 is a flowchart illustrating a method for creating parts of the LUT 15*a*. Here, a description will be given regarding a method for obtaining chromatic coordinates of pixel display point Gz on curve Wg extending between white point W and primary-color chromaticity point g so as to pass through pixel display point G.

The CPU 52 obtains the length $K_{WG}$ of one of the 255 equal parts of curve WG extending between white point W and pixel display point G (step S51). In step S52, variable d is set to 1. A position at a distance of $((255-d)\times K_{WG}/255)$ from white point W toward pixel display point G along curve Wg is set as temporary display point Gz' (step S53).

The CPU 52 determines whether or not temporary display point Gz' obtained in step S53 coincides with any displayable point on curve Wg (step S54). When the CPU 52 determines temporary display point Gz' to coincide with any displayable point, the process advances to step S55. Then, the CPU 52 sets the coincident displayable point as pixel display point Gz obtained on the basis of chromaticity point gz (step S55). Alternatively, when temporary display point Gz' is not determined to coincide with any displayable point in step S54, the process advances to step S56. Then, the CPU 52 obtains the closest displayable point to temporary display point Gz', and sets the obtained displayable point as pixel display point Gz (step S56).

In step S57, the CPU 52 increments the value of variable d by 1 (step S57), and determines whether or not variable d is 255 or higher (step S58). When variable d is determined to be 254 or lower, the process returns to step S53, and when variable d is determined to be 255 or higher, the process advances to step S59. The CPU 52 obtains a correction signal CV specifying image display point Gz, and stores it to the LUT 15*a* in correlation with an input signal DV (step S59).

Since pixel display point Gz is on or near curve Wg, the hue of the color specified by pixel display point Gz is also green. Moreover, according to equation (3), the lower the values of color components of the input signal DV other than the green component, the further the distance $K_{Gz'}$ from white point W, and therefore the correction signal CV specifying pixel display point Gz maintains the tone. Note that since pixel display point Gz is positioned within graphic H inside chromaticity point rs, the saturation of the color specified by pixel display point Gz is lower than the saturation of the color specified by chromaticity point gz.

Likewise, correction signals CV correlated to input signals DV for the hue of cyan with the red component in the range from 1 to 255, correction signals CV correlated to input signals DV for the hue of blue with the green and red components in the range from 1 to 255, and correction signals CV correlated to input signals DV for the hue of magenta with the green component in the range from 1 to 255 are sequentially obtained, and other correction signals CV are also obtained in a sequence up to correction signals CV correlated to input signals DV for the hue of yellow with the blue component in the range from 1 to 255.

Correction signals CV corresponding to all pixel display points for the hues of red, yellow, green, cyan, blue, and magenta may be obtained by the aforementioned method, or correction signals CV corresponding to only an appropriately selected group of the pixel display points for the hues may be obtained. In either case, the obtained correction signals CV are stored to the LUT 15*a* in correlation with input signals DV. Note that in the case where correction signals CV are obtained only for the selected pixel display points using the aforementioned method, the color correction circuit 15 reads necessary correction signals CV from among the correction signals CV stored in the LUT 15*a*, and obtains correction signals CV corresponding to unselected pixel display points by interpolation. Then, the obtained correction signals CV are outputted to the image signal line driver circuit 18. In this manner, only the correction signals CV corresponding to appropriately selected pixel display points are stored in the LUT 15*a*, thereby reducing the memory capacity of the LUT 15*a* compared to the case where all correction signals are stored. Moreover, the color correction circuit 15 also obtains correction signals CV corresponding to pixel display points specifying colors other than the hues of red, yellow, green, cyan, blue, and magenta, by interpolation on the basis of the correction signals CV being read from the LUT 15*a*, and outputs the obtained correction signals CV to the image signal line driver circuit 18.

Note that in the present embodiment, the chromatic coordinates of pixel display points Gz on curve WG are sequentially obtained in the direction from white point W to pixel display point G. However, the chromatic coordinates of pixel display points Gz on curve WG may be sequentially obtained in the direction from pixel display point G to white point W.

In the foregoing, the correspondence between the input signals DV and the correction signals CV is obtained using white point W specified by the input signal DV (255, 255, 255). However, a correction signal CV corresponding to an input signal DV may be obtained and additionally stored to the LUT 15*a*, using a point specified by an input signal (w, w, w) (where w is an integer such that $0 \leq w \leq 254$) in place of white point W.

The method for obtaining correction signals CV corresponding to pixel display points on or near curves connecting white point W to pixel display points R, Y, G, C, B, and M has been described above. As in the second embodiment, pixel display points on or near curves extending between adjacent pairs from pixel display points R, Y, G, C, B, and M, e.g., pixel display points R and Y, may further be obtained. In this case, from the signals correlated to the chromatic coordinates of displayable points obtained in advance, a signal corresponding to the chromatic coordinates of a pixel display point may be selected and additionally stored to the LUT 15*a* as a correction signal CV.

Figure 18:
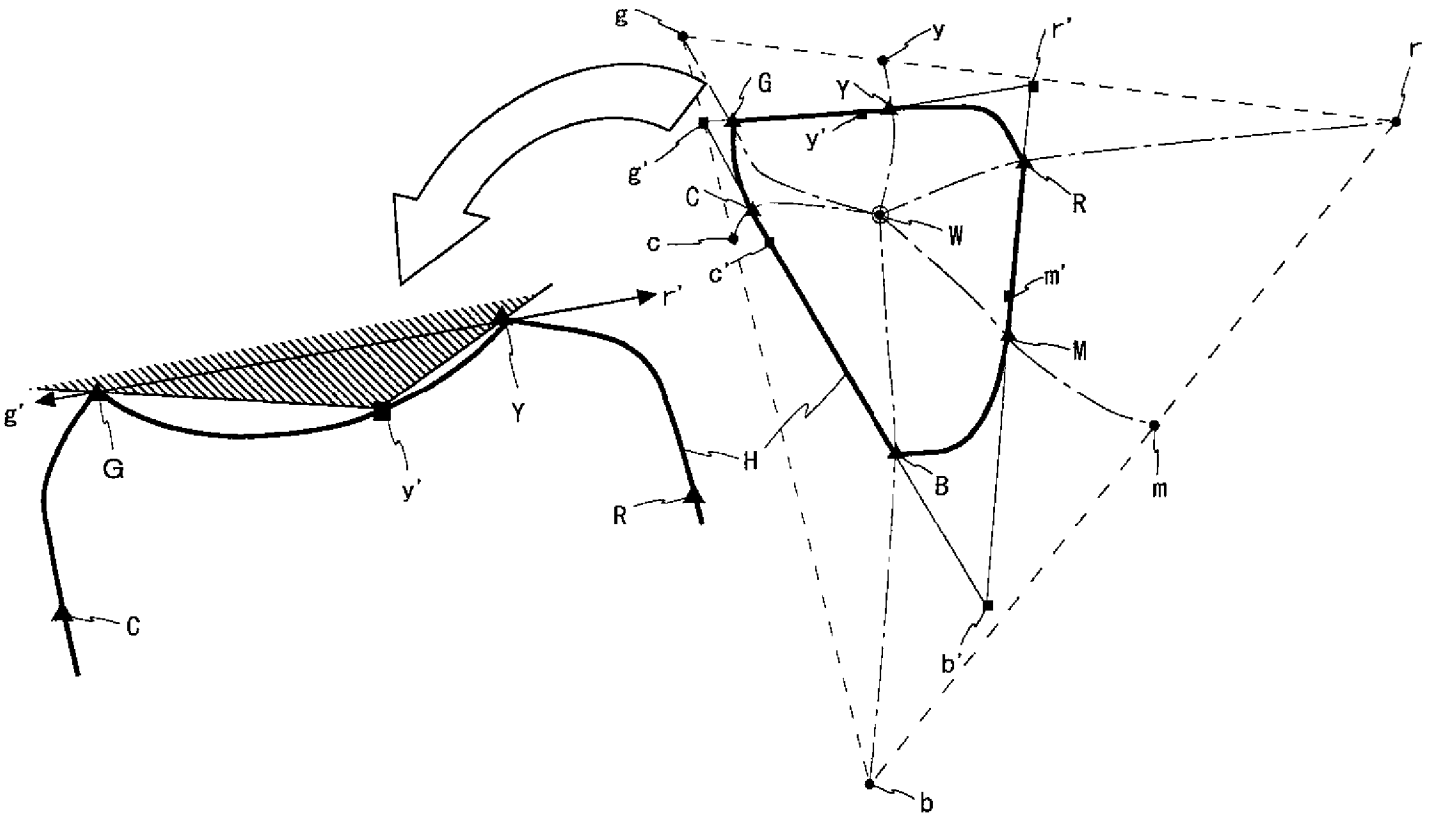
FIG. 18 is a diagram describing an effect of the liquid crystal display device according to the third embodiment.

As described above, the liquid crystal display device 10 according to the present embodiment achieves effects unique to the present embodiment while achieving the effects as described in the first and second embodiments. FIG. 18 is a diagram illustrating effects achieved by using an LUT created by the method as described in the present embodiment. Referring to FIG. 18, the effects of the present embodiment will be described. In the case where the liquid crystal display device 10 does not convert input signals DV to correction signals CV, the range of color reproduction is as represented by triangle r'g'b', and colors specified by displayable points in triangle r'g'b' are displayed. In this case, uncorrected chromaticity point y' is positioned on side r'g' of triangle r'g'b'. However, as shown in FIG. 18, uncorrected chromaticity point y' might be positioned inward from side r'g' rather than on side r'g'. In such a case, there is no displayable point within the hatched area in FIG. 18, so that for the liquid crystal display device 10 of the present embodiment, no displayable point is present on or near straight line GY extending between pixel display points G and Y. Accordingly, in the case where the closest displayable point to temporary display point Gz' obtained by the aforementioned method is selected as a pixel display point, the selected pixel display point might not be appropriate. However, by using the LUT 15*a* created by the method as described in the present embodiment, graphic H representing the range of color reproduction by the liquid crystal display device 10 can have a curved periphery, so that any displayable point within an area outside broken line Yy'G is not selected.

Furthermore, when the response speed of the liquid crystal used in the liquid crystal display device 10 is slow, the distance between a primary-color chromaticity point (e.g., point r) and an uncorrected chromaticity point (e.g., point r') is longer than in the case shown in FIG. 4, as shown in FIG. 15. In such a case, the range of color reproduction is reduced compared to the range of color reproduction shown in FIG. 4, resulting in a smaller number of colors that can be displayed by the liquid crystal display device 10. However, by using a curve instead of a straight line to obtain a pixel display point, as shown in FIG. 15, the periphery of graphic H representing the range of color reproduction can be curved outwardly, for example, between pixel display points R and Y and between pixel display points B and M. In this case, the number of displayable points enclosed within graphic H representing the range of color reproduction is increased, so that the liquid crystal display device 10 can display more colors even if the response speed of the liquid crystal is slow.

4. Other

In the embodiments of the present invention, the liquid crystal display device 10 can achieve significant effects particularly when displaying completely still images. However, the same effects can be achieved even in the case where images to be displayed are not completely but mostly still. While the foregoing has been given taking the liquid crystal display device as an example, the present invention can also be applied to other display devices such as organic EL display devices.

The present invention is suitable for display devices, such as liquid crystal display devices, which provide color display using a field-sequential system, particularly for a display device capable of displaying images in colors maintaining hues and tones expected from input signals.

The invention claimed is:

1. A field sequential display device for displaying a screen in a different color for each of a plurality of subframe periods into which a frame period is divided, the device comprising:

a display panel including a plurality of pixel formation portions arranged in a matrix; a color correction circuit for outputting correction signals for controlling light transmittances of the pixel formation portions, in each of the subframe periods on the basis of input signals; and a driver circuit for driving the pixel formation portions on the basis of the correction signals, wherein, the color correction circuit includes a look-up table having correction signals stored therein in correlation with the input signals specifying colors included in predetermined hues, the correction signals specifying colors maintaining hues and tones of the colors specified by the input signals, and when the input signals are provided, the color correction circuit reads the correction signals correlated to the input signals from the look-up table, and output the correction signals to the driver circuit.

2. The field sequential display device according to claim 1, wherein the correction signals stored in the look-up table in correlation with the input signals specify first pixel display points in a chromaticity diagram, the first pixel display points being on first straight lines extending between a white point with all color components of the input signals at maximum levels and first primary-color chromaticity points with at least one of the color components at a maximum level and the remaining at a minimum level, and the first pixel display points being obtained on the basis of the first primary-color chromaticity points.

3. The field sequential display device according to claim 2, wherein, when one of the first pixel display points is not on the first straight line, the correction signal stored in the look-up table in correlation with the input signal specifies a new first pixel display point being the closest displayable points to the first display point that is not on the first straight line within a predetermined distance therefrom.

4. The field sequential display device according to claim 2, wherein the correction signals stored in the look-up table in correlation with the input signals respectively specify a plurality of second pixel display points sequentially obtained between the white point and the first pixel display points on the first straight lines.

5. The field sequential display device according to claim 4, wherein the correction signals stored in the look-up table in correlation with the input signals respectively specify a plurality of second pixel display points obtained at intervals of equal length into which the first straight lines are divided.

6. The field sequential display device according to claim 4, wherein, when one of the second pixel display points is not on the first straight line, the correction signal stored in the look-up table in correlation with the input signal specifies a new second pixel display point being the closest displayable point to the second display point that is not on the first straight line.

7. The field sequential display device according to claim 2, wherein the correction signals stored in the look-up table in correlation with the input signals respectively specify a plurality of second pixel display points obtained at intervals of equal length into which first curves extending between the white point and the first pixel display points are divided.

8. The field sequential display device according to claim 2, wherein the correction signals stored in the look-up table in correlation with the input signals respectively specify a plurality of fourth pixel display points sequentially obtained on lines connecting the first pixel display points and third pixel display points obtained on the basis of the second primary-color chromaticity points adjacent to the first primary-color chromaticity points, the fourth pixel display points being positioned between the first pixel display points and the third pixel display points.

9. The display field sequential device according to claim 8, wherein the fourth pixel display points respectively specified by the correction signals stored in the look-up table in correlation with the input signals are obtained at intervals of equal length into which second straight lines connecting the first pixel display points and the third pixel display points are divided.

10. The field sequential display device according to claim 9, wherein, when one of the fourth pixel display points is not on the second straight line, the correction signal stored in the look-up table in correlation with the input signal specifies a new fourth pixel display point being the closest displayable point to the fourth pixel display point that is not on the second straight line.

11. The field sequential display device according to claim 8, wherein the fourth pixel display points respectively specified by the correction signals stored in the look-up table in correlation with the input signals are obtained at intervals of equal length into which second curves connecting the first pixel display points and the third pixel display points are divided.

12. The field sequential display device according to claim 1, further comprising a thermometer provided on the display panel, wherein, the correction signals stored in the look-up table are correlated to the input signals for each piece of temperature information provided by the thermometer, and when the input signals are provided, the color correction circuit reads the correction signals from the look-up table on the basis of the temperature information.

13. The field sequential display device according to claim 1, wherein the predetermined hues include red, green, and blue.

14. The field sequential display device according to claim 1, wherein images, including still images, are displayed on the display panel on the basis of the input signals.

* * * * *